US009131304B2

(12) United States Patent
Sakaguchi et al.

(10) Patent No.: US 9,131,304 B2
(45) Date of Patent: Sep. 8, 2015

(54) LOUDSPEAKER AND EQUIPMENT INCLUDING THE SAME

(71) Applicant: Panasonic Corporation, Osaka (JP)

(72) Inventors: Atsushi Sakaguchi, Osaka (JP); Shuji Saiki, Nara (JP); Toshiyuki Matsumura, Osaka (JP); Sawako Kano, Hyogo (JP); Akiko Fujise, Osaka (JP); Takafumi Yuasa, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/239,637

(22) PCT Filed: Jun. 19, 2013

(86) PCT No.: PCT/JP2013/003818

§ 371 (c)(1),
(2) Date: Feb. 19, 2014

(87) PCT Pub. No.: WO2013/190836

PCT Pub. Date: Dec. 27, 2013

(65) Prior Publication Data

US 2014/0205135 A1 Jul. 24, 2014

(30) Foreign Application Priority Data

Jun. 20, 2012 (JP) ..... 2012-138962
Jun. 20, 2012 (JP) ..... 2012-138963

(51) Int. Cl.
*H04R 9/06* (2006.01)
*H04R 9/02* (2006.01)
(Continued)

(52) U.S. Cl.
CPC ..... *H04R 9/025* (2013.01); *H04R 9/027* (2013.01); *H04R 1/227* (2013.01); *H04R 9/046* (2013.01); *H04R 2209/022* (2013.01)

(58) Field of Classification Search
CPC ..... H04R 1/227; H04R 9/02; H04R 9/025; H04R 9/027; H04R 9/041; H04R 9/046; H04R 31/006; H04R 2209/022
USPC ..... 381/150, 412, 415
See application file for complete search history.

(56) References Cited

U.S. PATENT DOCUMENTS 4,414,437 A 11/1983 Trauernicht et al.
8,391,515 B2 * 3/2013 Lu et al. ..... 381/410
(Continued)

FOREIGN PATENT DOCUMENTS

JP 59-161996 9/1984
JP 5-85194 11/1993
(Continued)

*Primary Examiner* — Brian Ensey
(74) *Attorney, Agent, or Firm* — Wenderoth, Lind & Ponack, L.L.P.

(57) ABSTRACT

A loudspeaker is provided which includes: a magnetic circuit including a magnet having at least one hole, a plate fixed to one of a pair of polar surfaces of the magnet, and a box-shaped yoke having an inner bottom surface fixed to the other polar surface of the magnet; a voice coil vertically vibratably provided in a magnetic gap formed by the plate and the yoke; a diaphragm having a peripheral edge connected to an upper end of the voice coil; and a magnetic fluid filled in at least one of a gap between the voice coil and the plate and a gap between the voice coil and the yoke. The loudspeaker includes at least one means for uniformly distributing the magnetic fluid.

18 Claims, 24 Drawing Sheets

(51) Int. Cl.
*H04R 1/22* (2006.01)
*H04R 9/04* (2006.01)

(56) References Cited

U.S. PATENT DOCUMENTS

| | | | | |
|---|---|---|---|---|
| 2007/0189577 | A1 | 8/2007 | Tsuda et al. | |
| 2009/0003644 | A1* | 1/2009 | Furuya | 381/400 |
| 2010/0203918 | A1* | 8/2010 | Watanabe | 381/400 |
| 2011/0044489 | A1 | 2/2011 | Saiki et al. | |
| 2011/0235849 | A1* | 9/2011 | Takewa | 381/412 |
| 2013/0051605 | A1 | 2/2013 | Tagami et al. | |

FOREIGN PATENT DOCUMENTS

| | | |
|---|---|---|
| JP | 06-006896 | 1/1994 |
| JP | 6-26396 | 4/1994 |
| JP | 10-126884 | 5/1998 |
| JP | 2000-032587 | 1/2000 |
| JP | 2000-134696 | 5/2000 |
| JP | 2002-191093 | 7/2002 |
| JP | 2002-374595 | 12/2002 |
| JP | 2005-223720 | 8/2005 |
| JP | 2006-108975 | 4/2006 |
| JP | 2007-142836 | 6/2007 |
| JP | 2007-221787 | 8/2007 |
| JP | 2008-136066 | 6/2008 |
| JP | 2009-049762 | 3/2009 |
| JP | 2009-088902 | 4/2009 |
| JP | 2009-253795 | 10/2009 |
| JP | 2010-258963 | 11/2010 |
| JP | 2011-223559 | 11/2011 |
| JP | 2013-46112 | 3/2013 |
| WO | 2009/016743 | 2/2009 |
| WO | 2009/066415 | 5/2009 |

* cited by examiner

200

FIG. 22 - Prior Art
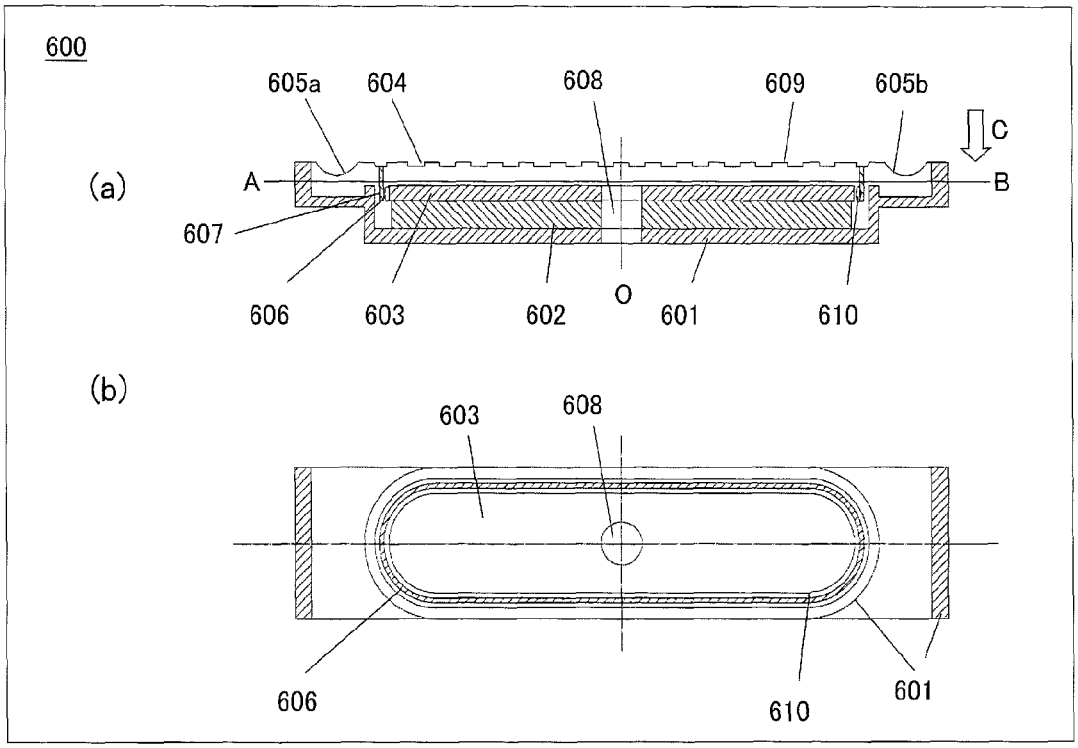

FIG. 23 - Prior Art
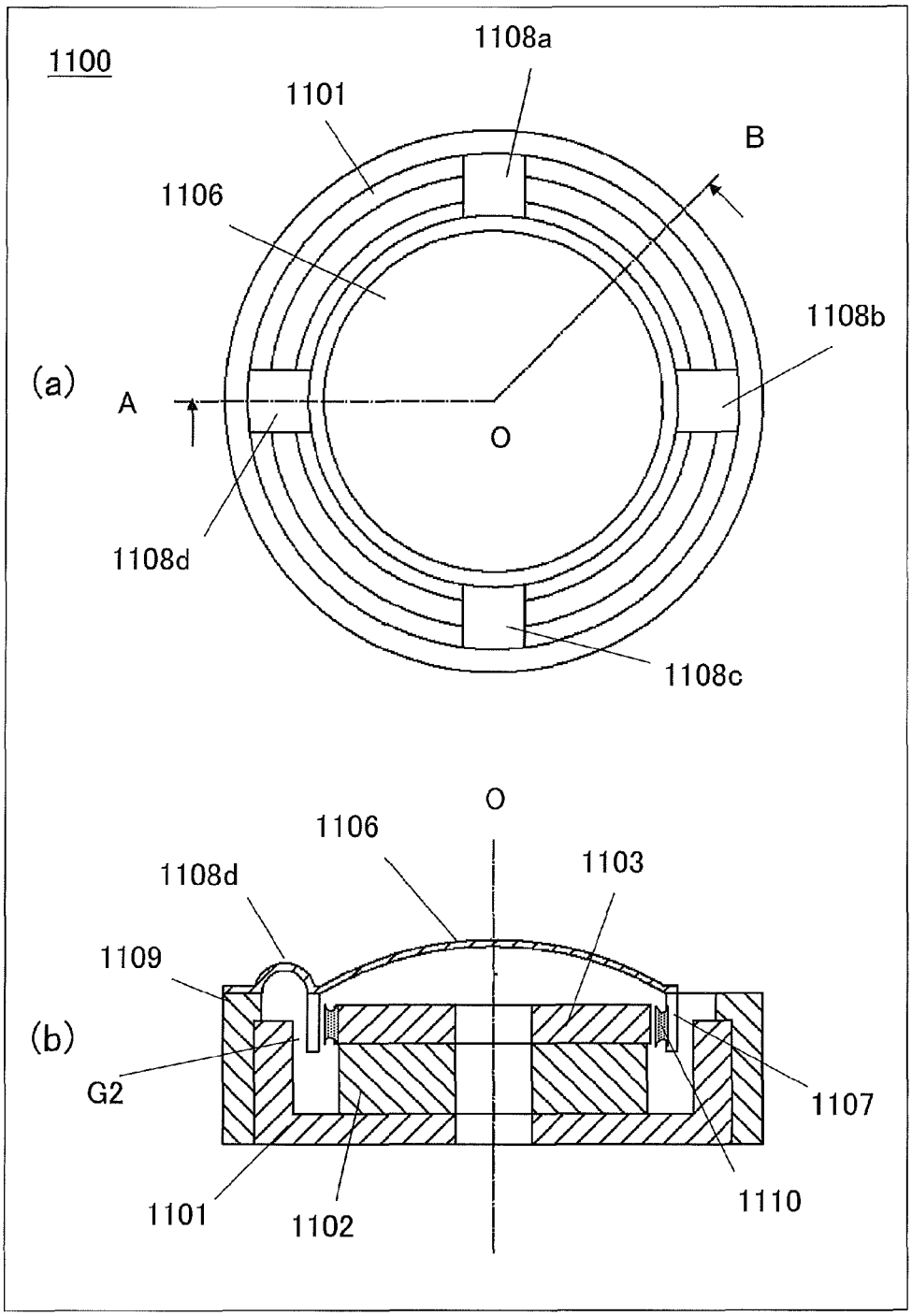

FIG. 24 - Prior Art
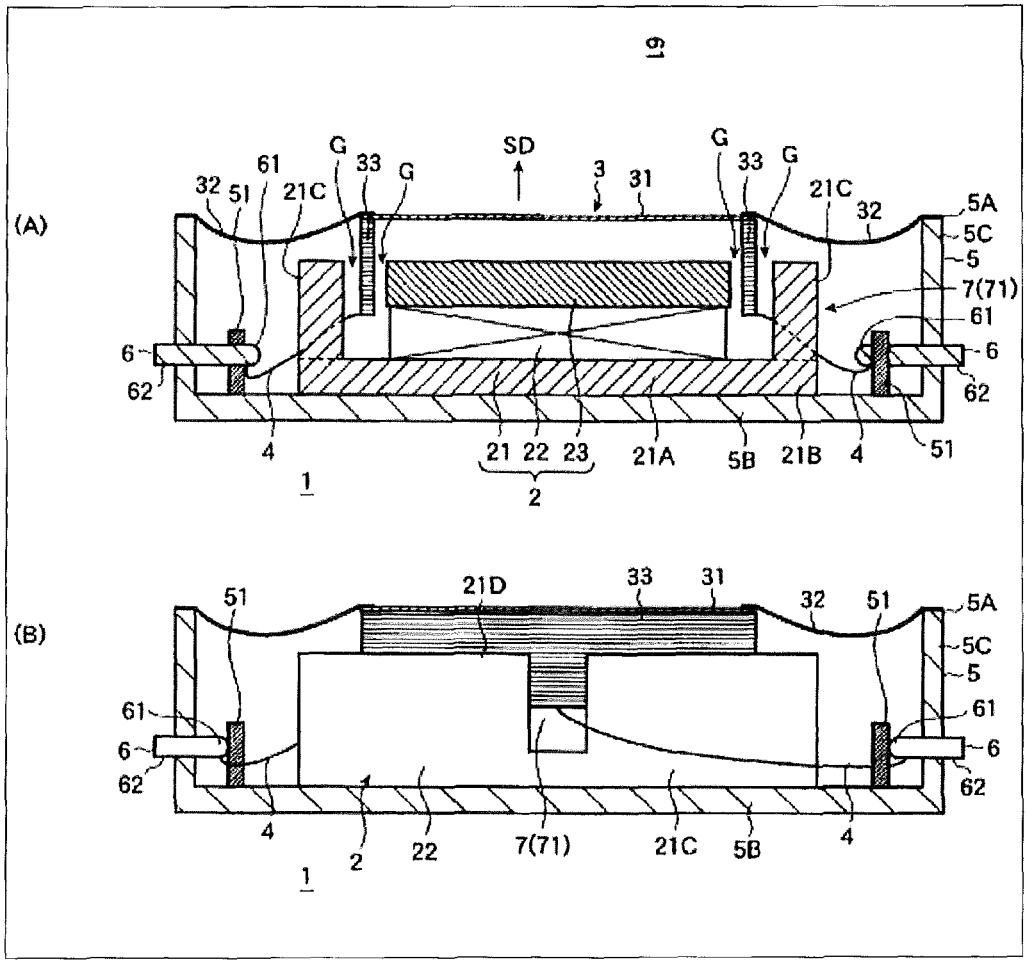

LOUDSPEAKER AND EQUIPMENT INCLUDING THE SAME

TECHNICAL FIELD

The present invention relates to a configuration of a loudspeaker.

BACKGROUND ART

In recent years, in order to meet demands for stylish appearances of TVs and mobile equipment, frame narrowing has been progressed which narrows an outer frame surrounding a display device. Therefore, the shape of a loudspeaker generally installed in a frame is desired to be slimmer.

However, in a slim loudspeaker, since the width thereof in a short side direction is narrowed, a sufficient width of a suspension that holds a diaphragm cannot be secured. Therefore, stiffness of the suspension increases, and a minimum resonant frequency f0 of the loudspeaker also increases. As a result, low-frequency characteristics are degraded, and reproduction frequency bandwidth is reduced. As a countermeasure to this problem, Patent Literature 1 proposes a conventional loudspeaker which is a slim loudspeaker utilizing a magnetic fluid and separated suspensions and in which reproduction frequency bandwidth is not reduced.

FIG. 22(*a*) is a diagram showing a cross-sectional view of a loudspeaker 600 using a magnetic fluid and separated suspensions, which is the conventional loudspeaker disclosed in Patent Literature 1. FIG. 22(*b*) is a cross-sectional view of the loudspeaker 600 taken along a line A-B in FIG. 22(*a*) and viewed in a direction of an arrow C. The loudspeaker 600 includes a yoke 601, a magnet 602, a plate 603, a diaphragm 604, suspensions 605*a* and 605*b*, a voice coil 606, a sound hole 608, ribs 609, and a magnetic fluid 610. The magnet 602, whose front outer shape is a track shape, is bonded to an inner bottom surface of the box-shaped yoke 601 with an upper surface being opened. The plate 603, whose front outer shape is a track shape, is bonded to an upper surface of the magnet 602. A magnetic gap 607 is formed between the yoke 601 and the plate 603. Thus, the yoke 601, the magnet 602, and the plate 603 form a magnetic circuit having the magnetic gap 607. The sound hole 608 is formed penetrating through the yoke 601, the magnet 602, and the plate 603 along a central axis O. The diaphragm 604 is formed with a plurality of ribs 609 parallel to the short sides of the diaphragm 604. The suspensions 605*a* and 605*b* are provided on the short sides of the diaphragm 604, as a support that vibratably supports the diaphragm 604. That is, a suspension is not provided surrounding the entire circumference of the diaphragm 604, but a plurality of independent suspensions (separated suspensions) are provided on portions of the diaphragm 604. The suspensions 605*a* and 605*b* are made of the same material as that of the diaphragm 604, and are formed integrally with the diaphragm 604. The voice coil 606, whose front outer shape and front inner shape are track shapes, is provided in the magnetic gap 607. In addition to the voice coil 606, the magnetic fluid 610 is filled in the magnetic gap 607. In the conventional loudspeaker 600 disclosed in Patent Literature 1, the magnetic fluid 610 is filled only on an inner circumference side of the voice coil 606 in the magnetic gap 607.

According to the above configuration, the suspensions 605*a* and 605*b* that vibratably support the diaphragm 604 are provided at the different positions on the outer circumference of the diaphragm 604. Therefore, even when the loudspeaker is reduced in size, the stiffness can be reduced by adjusting the width and thickness of the suspensions 605*a* and 605*b*, and thus the minimum resonance frequency can be reduced. Further, since the magnetic gap 607 is filled with the magnetic fluid 610, interference between sound waves which occurs at the surfaces of the diaphragm 604, and rolling can be suppressed. As described above, by using the loudspeaker 600 that utilizes the magnetic fluid 610 and the separated suspensions 605*a* and 605*b*, it is possible to suppress reduction in the reproduction frequency bandwidth that is a problem in a slim loudspeaker.

CITATION LIST

Patent Literature

[PTL 1] International Publication No. 2009/066415
[PTL 2] International Publication No. 2009/016743

SUMMARY OF THE INVENTION

Problems to be Solved by the Invention

In the conventional loudspeaker 600, it is possible to suppress reduction in the reproduction frequency bandwidth by utilizing the separated suspensions 605*a* and 605*b* and the magnetic fluid 610. However, the conventional loudspeaker 600 has been configured without taking into account uniform distribution of the magnetic fluid 610 in the magnetic gap 607. Therefore, in a slim loudspeaker like the conventional loudspeaker 600, the magnetic fluid 610 may be locally concentrated in some cases, which may cause an air gap in the magnetic gap 607 between the voice coil 606 and the plate 603, resulting in rolling and degradation of low-frequency characteristics.

Solution to the Problems

A loudspeaker according to the present disclosure includes: a magnetic circuit including a magnet, a plate fixed to one of a pair of polar surfaces of the magnet, and a box-shaped yoke having an inner bottom surface fixed to the other polar surface of the magnet; a voice coil provided in a magnetic gap formed by the plate and the yoke, the voice coil being vibratable in a vertical direction; a diaphragm having a peripheral edge connected to an upper end of the voice coil; and a magnetic fluid filled in at least one of a gap between the voice coil and the plate and a gap between the voice coil and the yoke. The loudspeaker includes at least one means for uniformly distributing the magnetic fluid.

A loudspeaker according to the present disclosure includes: a magnetic circuit including a magnet, a plate fixed to one of a pair of polar surfaces of the magnet, and a box-shaped yoke having an inner bottom surface fixed to the other polar surface of the magnet; a voice coil provided in a magnetic gap formed by the plate and the yoke, the voice coil being vibratable in a vertical direction; a diaphragm having a peripheral edge connected to an upper end of the voice coil; and a magnetic fluid filled in at least one of a gap between the voice coil and the plate and a gap between the voice coil and the yoke. A shape of an inner edge of an outer magnetic pole of the magnetic circuit with respect to the voice coil and a shape of an outer edge of an inner magnetic pole of the magnetic circuit with respect to the voice coil 106 are each composed of, as viewed from the top, two substantially linear portions opposed to each other, and two curved portions opposed to each other and having an outwardly convex shape. A gap between the inner edge of the outer magnetic pole and the outer edge of the inner magnetic pole is formed by the linear portions of the outer magnetic pole and the inner magnetic pole and the curved portions of the outer magnetic pole and the inner magnetic pole. The gap is smaller between the curved portions than between the linear portions.

Advantageous Effects of the Invention

According to the present disclosure, since the magnetic fluid can be uniformly distributed in the magnetic gap, generation of an air gap in the magnetic gap can be suppressed, thereby avoiding degradation in low-frequency characteristics due to sound leakage, and rolling.

BRIEF DESCRIPTION OF THE DRAWINGS

FIG. 22 is a diagram showing structural cross-sectional views of the conventional loudspeaker.

FIG. 23 is a diagram showing structural cross-sectional views of a loudspeaker disclosed in Patent Literature 1.

FIG. 24 is a diagram showing structural cross-sectional views of a loudspeaker disclosed in Patent Literature 2.

DESCRIPTION OF EMBODIMENTS

Figure 1:
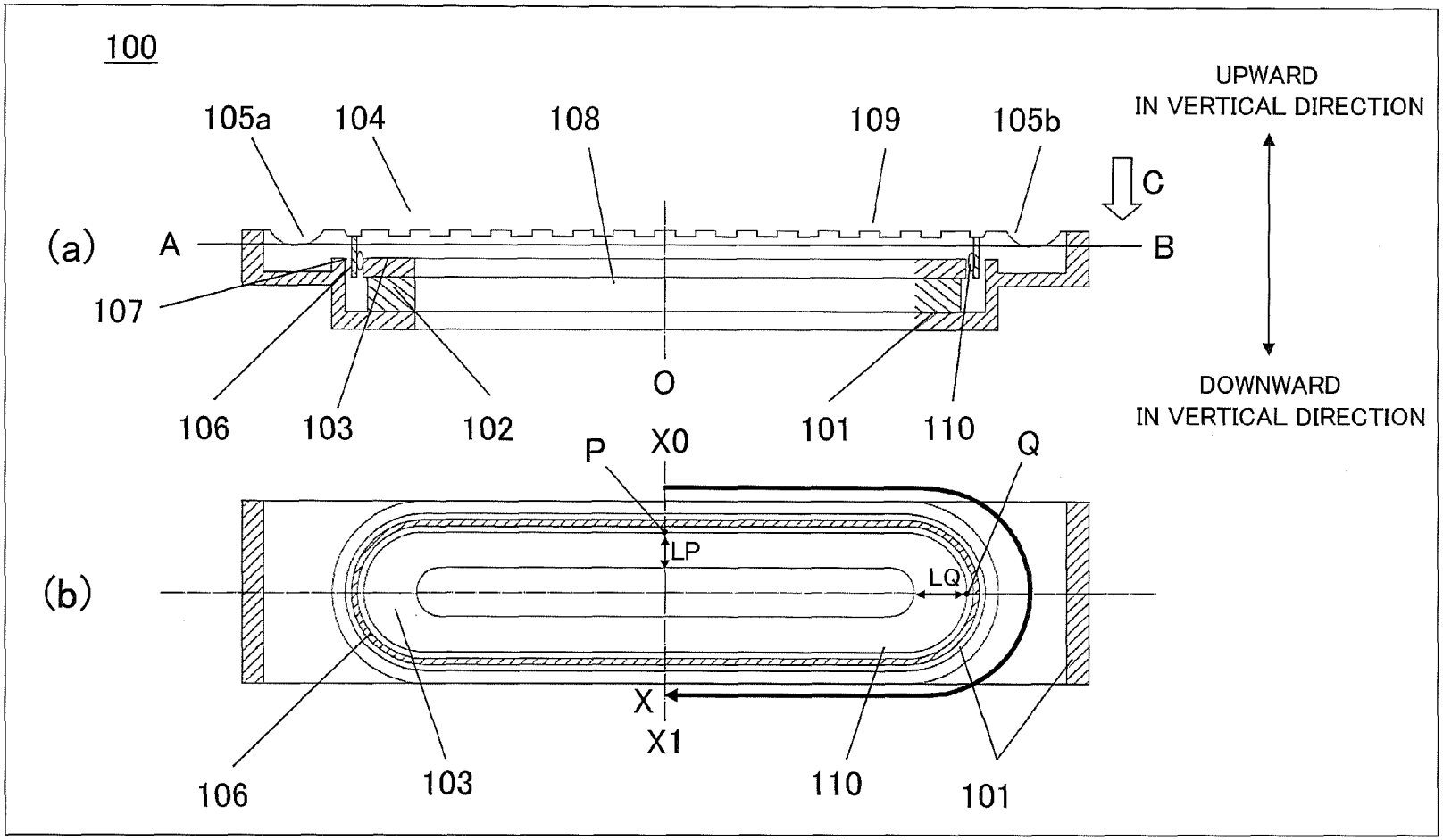
FIG. 1 is a diagram showing cross-sectional views of a loudspeaker according to the present disclosure.

The present disclosure includes a first loudspeaker including: a magnetic circuit including a magnet, a plate fixed to one of a pair of polar surfaces of the magnet, and a box-shaped yoke having an inner bottom surface fixed to the other polar surface of the magnet; a voice coil provided in a magnetic gap formed by the plate and the yoke, the voice coil being vibratable in a vertical direction; a diaphragm having a peripheral edge connected to an upper end of the voice coil; and a magnetic fluid filled in at least one of a gap between the voice coil and the plate and a gap between the voice coil and the yoke. The first loudspeaker includes at least one means for uniformly distributing the magnetic fluid.

The present disclosure further includes a second loudspeaker including: a magnetic circuit including a magnet, a plate fixed to one of a pair of polar surfaces of the magnet, and a box-shaped yoke having an inner bottom surface fixed to the other polar surface of the magnet; a voice coil provided in a magnetic gap formed by the plate and the yoke, the voice coil being vibratable in a vertical direction; a diaphragm having a peripheral edge connected to an upper end of the voice coil; and a magnetic fluid filled in at least one of a gap between the voice coil and the plate and a gap between the voice coil and the yoke. In the second loudspeaker, a shape of an inner edge of an outer magnetic pole of the magnetic circuit with respect to the voice coil and a shape of an outer edge of an inner magnetic pole of the magnetic circuit with respect to the voice coil 106 are each composed of, as viewed from the top, two substantially linear portions opposed to each other, and two curved portions opposed to each other and having an outwardly convex shape. A gap between the inner edge of the outer magnetic pole and the outer edge of the inner magnetic pole is formed by the linear portions of the outer magnetic pole and the inner magnetic pole and the curved portions of the outer magnetic pole and the inner magnetic pole. The gap is smaller between the curved portions than between the linear portions.

Thereby, the magnetic fluid can be uniformly distributed in the magnetic gap, and therefore, generation of an air gap in the magnetic gap can be suppressed, thereby avoiding degradation in low-frequency characteristics due to sound leakage, and rolling.

As another example of the first loudspeaker, the following configuration may be adopted.

For example, the first loudspeaker may have, as the above means, a sound hole provided penetrating through the plate and the magnet.

Further, for example, the sound hole may be formed by combining openings of the same shape which are formed in the plate and the magnet, respectively.

Further, for example, given that, as viewed in a direction along a through-axis of the sound hole, a point on an outer circumference of the plate closest to a center of gravity of the sound hole is a first point, a shortest distance between the first point and an outer circumference of the sound hole is a first distance, a point on the outer circumference of the plate farthest from the center of gravity of the sound hole is a second point, and a shortest distance between the second point and the outer circumference of the sound hole is a second distance, the first distance is smaller than the second distance. Thus, the magnetic flux distribution is uniformized by adjusting the distances, thereby realizing uniform distribution of the magnetic fluid.

The following configuration is proposed as another method of uniformizing magnetic flux distribution by distance adjustment.

For example, the first loudspeaker may include, as the above means, a plurality of sound holes provided penetrating through the plate, the magnet, and the yoke, each sound hole being formed by combining openings of the same shape which are formed in the plate, the magnet, and the yoke, respectively.

Further, for example, the sound hole may be provided at least in an area where a magnetic flux density is high.

Further, for example, an outer circumferential shape of a horizontal cross section of the magnet may be a track shape, and the sound hole may have a track shape as viewed in the direction along the through-axis, and be provided at a position in which a magnetic flux density of a magnetic flux penetrating the outer circumference of a linear portion of the magnet is to be reduced.

Alternatively, for example, the first loudspeaker may include, as the above means, the voice coil whose shape is adjusted so as to cause the magnetic fluid to uniformly distribute in the gap.

Alternatively, for example, a sound hole penetrating through the plate, the magnet, and the yoke may be provided by combining openings of the same shape which are formed in the plate, the magnet, and the yoke, respectively. Given that, as viewed in a direction along a through-axis of the sound hole, a point on an outer circumference of the plate closest to a center of gravity of the sound hole is a third point, a shortest distance between the third point and the voice coil is a third distance, a point on the outer circumference of the plate farthest from the center of gravity of the sound hole is a fourth point, and a shortest distance between the fourth point and the voice coil is a fourth distance, the third distance is larger than the fourth distance.

Alternatively, for example, the first loudspeaker may include, as the above means, auxiliary magnets provided outside the voice coil.

Further, for example, a horizontal cross section of the voice coil may have a track shape, and the auxiliary magnets may be provided on the outer circumference of the voice coil at both the short sides thereof so as to have a radius of curvature equal to that of the outer circumference of the plate.

It is also possible to configure AV (Audio Visual) equipment, such as a television, a mobile phone, a smartphone, a tablet terminal, an earphone, and a hearing aid, which includes the above-described loudspeaker.

As another example of the second loudspeaker, the following configuration may be adopted.

For example, the magnetic circuit may have a track shape or a rectangular shape as viewed from the top.

Further, for example, the yoke may have, in the curved portion, at least two slits through which lead wires of the voice coil are taken out of the magnetic circuit. Thereby, the lead wires of the voice coil are prevented from contacting other components. Further, the magnetic gap width at the slits is reduced as compared to that at other areas to uniformly distribute the magnetic fluid, thereby providing a small-sized loudspeaker with high efficiency and high linearity.

Specific examples of the slits are as follows.

For example, the slits may be cutouts extending to an upper end of the yoke.

Alternatively, for example, the slits may be through holes provided in a side wall of the yoke so as to have a predetermined clearance at each of upper and lower limits of a swing of the lead lines.

It is possible to configure an inner-ear headphone, a mobile information terminal, and a tablet type video audio information terminal, each including the above-described loudspeaker.

(Findings Obtained from Conventional Art)

Since the conventional loudspeaker 600 is configured without taking into consideration uniform distribution of the magnetic fluid 610 in the magnetic gap 607, the magnetic fluid 610 may be locally concentrated. The inventors of the present application has found that such local concentration of the magnetic fluid is caused by the slim shape of the loudspeaker. In the slim loudspeaker, the magnetic flux density in the curved portion of the magnetic gap is not uniform. For example, in the conventional loudspeaker 600, the voice coil 606 and the plate 603 that form the magnetic gap 607 are configured to have a track shape (a shape composed of two parallel linear segments and two curved segments connecting the linear segments at their opposite ends). Since diffusion of the magnetic flux is greater in the curved portion of the magnetic gap 607 than in the straight line portion thereof, the magnetic flux density is lower in the curved portion of the magnetic gap 607 than in the linear portion thereof. Therefore, in some cases, the magnetic fluid is locally concentrated, and an air gap is formed in the magnetic gap 607 between the voice coil 606 and the plate 603, which may cause degradation in low-frequency characteristics and rolling. The present disclosure resolves these problems.

Hereinafter, exemplary embodiments of the present disclosure will be described with reference to the drawings. It should be noted that each of the embodiments described hereafter illustrates a preferred example of the present disclosure. The numerical values, shapes, materials, components, the arrangement and connection of the components, steps, the processing order of the steps etc. shown in the following exemplary embodiments are mere examples, and are not intended to limit the present disclosure. The present disclosure is limited only by the scope of the claims. Accordingly, among the components in the following embodiments, components not recited in any of independent claims indicating the most generic concept of the present disclosure are not essential for achieving the object of the present disclosure but are described as preferable components. The same reference numerals are assigned to the same components, and the description thereof may be omitted.

Embodiment 1

FIG. 1 shows cross-sectional views of a loudspeaker 100 according to the present disclosure. In the following description, as shown by an arrow on a right side in FIG. 1(*a*), a vertical direction is defined such that an upper part of the drawing is an upper side in the vertical direction, and a lower part of the drawing is a lower side in the vertical direction. A horizontal direction is a direction perpendicular to the vertical direction. Further, in the description with reference to FIG. 1, a "vibration direction" means the same direction as the vertical direction. FIG. 1(*a*) is a vertical cross-sectional view of the loudspeaker 100, and FIG. 1(*b*) is a cross-sectional view of the loudspeaker 100 taken along a line A-B in FIG. 1(*a*) and viewed in a direction of an arrow C. The loudspeaker 100 includes a yoke 101, a magnet 102, a plate 103, a diaphragm 104, suspensions 105*a* and 105*b*, a voice coil 106, a sound hole 108, and a magnetic fluid 110. A magnetic gap 107 is formed by the yoke 101, the magnet 102, and the plate 103. The voice coil 106 and the magnetic fluid 110 are provided in the magnetic gap 107. Hereinafter, the respective components will be described.

The yoke 101 has a box shape with an upper surface being opened. The yoke 101 has, in the center of a bottom surface thereof, an opening having a track-shaped open end, and the opening forms a part of the sound hole 108. Two parallel segments of the track shape are composed of two straight line parts, and two curves connecting the segments at their opposite ends are composed of two curved parts each being curved in an arc shape that protrudes outward. That is, the opening of the yoke 101 has linear long sides and curved short sides. Further, the yoke 101 is made of a magnetic material.

The outer circumferential shape of a horizontal cross section of the magnet 102 is a track shape. The magnet 102 has an opening in the center thereof, and the opening forms a part of the sound hole 108. The shape of the opening of the magnet 102 is the same as the shape of the opening of the yoke 101. Further, the magnet 102 is bonded to the inner bottom surface of the yoke 101 such that the position of the opening of the magnet 102 is aligned with the position of the opening of the yoke 101. The magnet 102 is polarized in the same direction as the vibration direction of the diaphragm 104.

The outer circumferential shape of a horizontal cross section of the plate 103 is a track shape. Like the yoke 101 and the magnet 102, the plate 103 has an opening in the center thereof, and the opening forms a part of the sound hole 108. The opening of the plate 103 has the same shape as the shape of the opening of the yoke 101. Further, the plate 103 is fixed to, by adhesion or the like, an upper surface of the magnet 102 that is one of a pair of polar surface of the magnet 102 such that the position of the opening of the plate 103 is aligned with the position of the opening of the magnet 102. A lower surface of the magnet 102 that is the other polar surface of the magnet 102 is fixed to, by adhesion or the like, the inner bottom surface of the yoke 101, as described above. The magnetic fluid 110 is in contact with the outer circumference of the plate 103. The plate 103 is made of a magnetic material. Assuming that, viewed in a direction along a through-axis of the sound hole 108, a point (first point) on the outer circumference of the plate 103 closest to the center of gravity of the sound hole 108 is P, a shortest distance between the point P and the outer circumference of the sound hole 108 is LP (first distance), a point (second point) on the outer circumference of the plate 103 farthest from the center of gravity of the sound hole 108 is Q, and a shortest distance between the point Q and the outer circumference of the sound hole 108 is LQ (second distance), a relationship, LP<LQ, is satisfied. The sound hole 108 may be formed by only the opening of the plate 103 and the opening of the magnet 102. In this case, in the yoke 101, at least an opening to be aligned with the opening of the plate 103 and the opening of the magnet 102 is not provided.

The outer circumferential shape of a horizontal cross section of the diaphragm 104 is a track shape. That is, the diaphragm 104 has linear long sides and curved short sides. Further, the diaphragm 104 is made of the same material as the suspensions 105*a* and 105*b*, and the curved portions of the diaphragm 104 are integrally formed with the suspensions 105*a* and 105*b*. The diaphragm 104 need not be integrally formed with the suspensions 105*a* and 105*b*, and need not be made of the same material as the suspensions 105*a* and 105*b*. An upper end of the voice coil 106 is fixed by adhesion or the like to a bottom outer circumferential part of a peripheral edge of the diaphragm 104. Further, as shown in FIG. 1(*a*), a plurality of ribs 109 parallel to the short sides of the diaphragm 104 may be formed. The ribs 109 suppress a resonance in the audible range.

The suspensions 105*a* and 105*b* are bonded to the diaphragm 104 and the yoke 101. The sides of the suspensions 105*a* and 105*b* bonded to the diaphragm 104 are curved. The sides of the suspensions 105*a* and 105*b* bonded to the yoke 101 are linear. Since a suspension is not provided surrounding the entire circumference of the diaphragm but a plurality of suspensions 105*a* and 105*b* are bonded to portions (curved portions) of the diaphragm, the suspensions 105*a* and 105*b* are referred to as separated suspensions. In addition, a vertical cross-sectional shape of the suspension 105*a*, 105*b* is non-linear. This non-linear shape enables the diaphragm 104 to be vibratably held. The vertical cross-sectional shape of the suspension 105*a*, 105*b* may protrude downward in the vibration direction as shown in FIG. 1(*a*), or may protrude upward in the vibration direction. The shape of the suspension 105*a*, 105*b* is not limited to the above-mentioned shapes. For example, the sides thereof bonded to the yoke 101 may be curved. In this case, of course, the sides of the yoke 101 bonded to the suspensions 105*a* and 105*b* are curved.

The horizontal cross-sectional shape of the voice coil 106 is a track shape, and the three-dimensional shape thereof is a cylindrical shape. The vertical upper end of the voice coil 106 is bonded to the bottom outer circumference of the diaphragm 104. Further, the vertical lower end of the voice coil 106 is provided in the magnetic gap 107. Further, the magnetic fluid 110 is in contact with the inner circumference of the vertical lower end of the voice coil 106. Thereby, the voice coil 106 is provided in the magnetic gap 107 so as to be vibratable in the vertical direction.

The sound hole 108 (means for uniformly distributing the magnetic fluid) is formed by the openings that are formed through the yoke 101, the magnet 102, and the plate 103 so as to have the same shape. The shape of the sound hole 108 is a track shape viewed in the direction along the through-axis as shown in FIG. 1(*b*).

The magnetic fluid 110 is loaded into the space between the outer circumference of the plate 103 and the inner circumference of the voice coil 106 without any void remained in the space. Generally, the magnetic fluid 110 may be filled in at least one of the gap between the voice coil 106 and the plate 103 and the gap between the voice coil 106 and the yoke 101.

Hereinafter, the operation of the loudspeaker 100 configured as described above will be described. When an electric signal is input to the voice coil 106, the voice coil 106 vibrates in accordance with the Fleming's left-hand rule. Since the voice coil 106 is bonded to the diaphragm 104, a sound wave is generated from the diaphragm 104. At this time, since the suspensions 105*a* and 105*b* do not cover the entire circumference of the diaphragm 104 but are locally bonded to the diaphragm 104, the stiffness of the suspensions 105*a* and 105*b* is sufficiently lower than the stiffness of the usual suspension that surrounds the entire circumference of the diaphragm. Thereby, the minimum resonance frequency can be reduced, and reduction in the reproduction frequency bandwidth can be suppressed.

Further, since the sound hole 108 is designed such that the magnetic fluid 110 is uniformly distributed on the outer side surface of the plate 103, it is possible to uniformly distribute the magnetic fluid 110 in the magnetic gap formed on the inner side of the voice coil 106.

Figure 2:
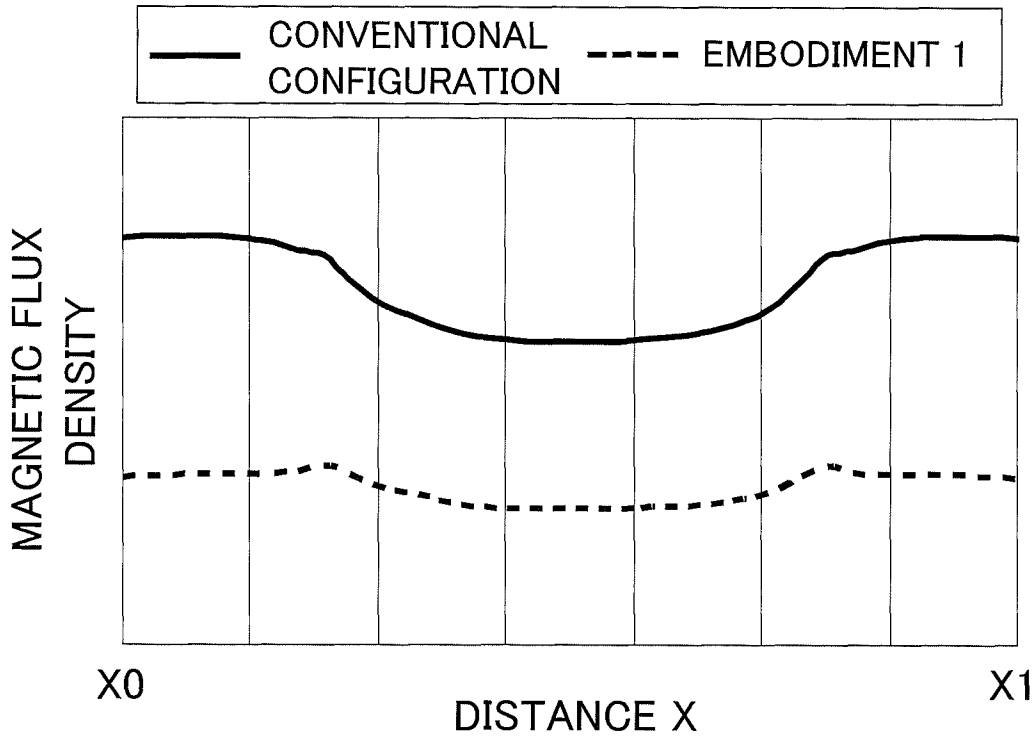
FIG. 2 is a diagram showing a difference in magnetic flux density distribution between the conventional loudspeaker and the loudspeaker according to the present disclosure.

FIG. 2 shows a result of comparison between the magnetic flux density distribution on the plate side surface in the present disclosure and that in the conventional configuration. In FIG. 2, a horizontal axis indicates positions within a distance X along the outer circumference of the plate between a position X0 of the point P and a position X1 of the point Q as shown by an arrow in FIG. 1(*b*), and a vertical axis shows the magnetic flux density. The result of the magnetic flux density distribution in the conventional configuration is shown by a solid line, and the result of the magnetic flux density distribution of the present disclosure is shown by a dotted line. As shown in FIG. 2, in the conventional configuration, the distribution of magnetic flux density is not uniform due to influences by the sound hole and the curved portion of the magnetic gap, whereas, in the present disclosure, the sound hole is designed so as to make the magnetic flux density distribution in the magnetic gap uniform, and therefore, the distribution of the magnetic flux density is uniform as compared to the conventional configuration. Therefore, in the present disclosure, it is possible to uniformly distribute the magnetic fluid 110 on the side surface of the plate 103.

Figure 3:
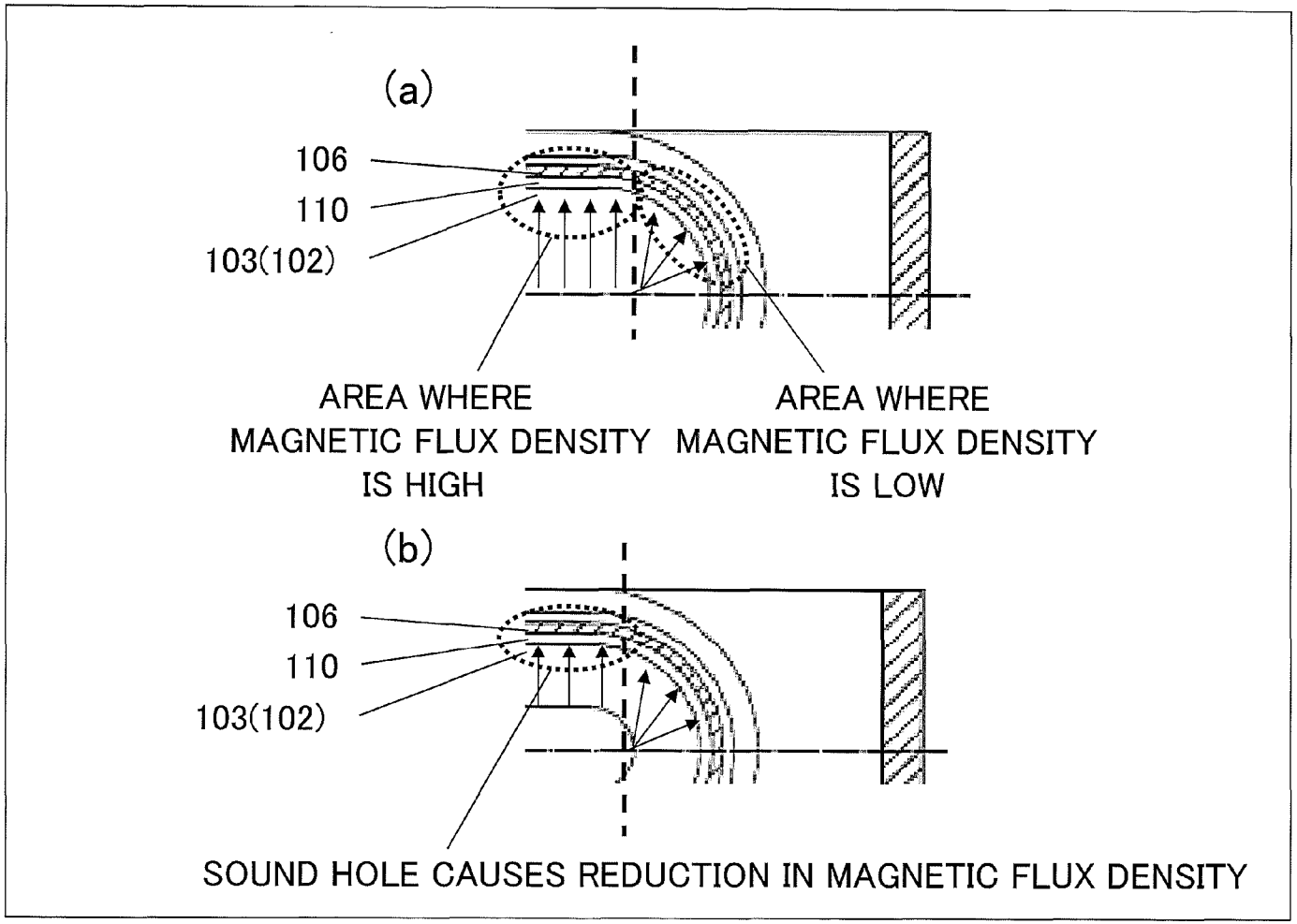
FIG. 3 is a diagram showing partially enlarged views of the conventional loudspeaker and the loudspeaker according to the present disclosure.

The reason why the distribution of the magnetic flux density can be made uniform by providing the sound hole 108 of the present disclosure will be described. FIG. 3(*a*) shows an enlarged portion of the conventional loudspeaker 600, and FIG. 3(*b*) shows an enlarged portion of the loudspeaker 100 of the present disclosure. As shown in FIG. 3(*a*), in the conventional loudspeaker, the magnetic flux density is high in the linear portions of the track shape, and low in the curved portions of the track shape. On the other hand, in the present disclosure shown in FIG. 3(*b*), since the sound hole 108 is formed, the magnetic flux density in the linear portions is reduced. Accordingly, the distribution of the magnetic flux density is made uniform. By providing such a sound hole in, for example, at least a part where the magnetic flux density is supposed to be relatively high if the sound hole is absent, it is possible to make the distribution of the magnetic flux density uniform. In a loudspeaker having a track-shaped magnet like the loudspeaker 100, a sound hole is provided at a position where the density of a magnetic flux penetrating the outer circumference of a linear portion of the magnet is to be reduced, for example.

For the above reasons, in the loudspeaker 100 according to the present disclosure, in contrast to the conventional loudspeaker 600, the magnetic fluid 110 is not locally concentrated. Thereby, no gap is formed in the space between the outer circumference of the plate 103 and the inner circumference of the voice coil 106, and therefore, the sound hole 108 and the space beneath the diaphragm 104 are maintained to be sealed with the magnetic fluid. That is, leakage of generated sound from the sound hole 108 and the space beneath the diaphragm 104 to the spaces beneath the separated suspensions is suppressed. That is, it is possible to prevent degradation of low-frequency characteristics due to sound leakage, and rolling.

Further, since the sound hole 108 is designed such that the magnetic fluid 110 is uniformly distributed on the outer side surface of the plate 103, it is possible to uniformly inject the magnetic fluid 110 when injecting the magnetic fluid into the magnetic circuit in the assembly stage. Accordingly, it is possible to prevent the magnetic fluid 110 from attaching to the inner side surface of the yoke 101.

Regarding sound waves emitted from the sound hole 108, since the sound hole 108 is provided extending along the long side direction in the present disclosure, it is possible to prevent the sound waves emitted from the center and the edge of the diaphragm 104 from interfering with each other due to the difference in their path lengths. Thereby, even when the loudspeaker 100 has such a slim shape, the loudspeaker 100 can emit the sound waves without degrading high-frequency characteristics that are likely to be affected by the interference due to the difference in the path lengths.

Figure 4:
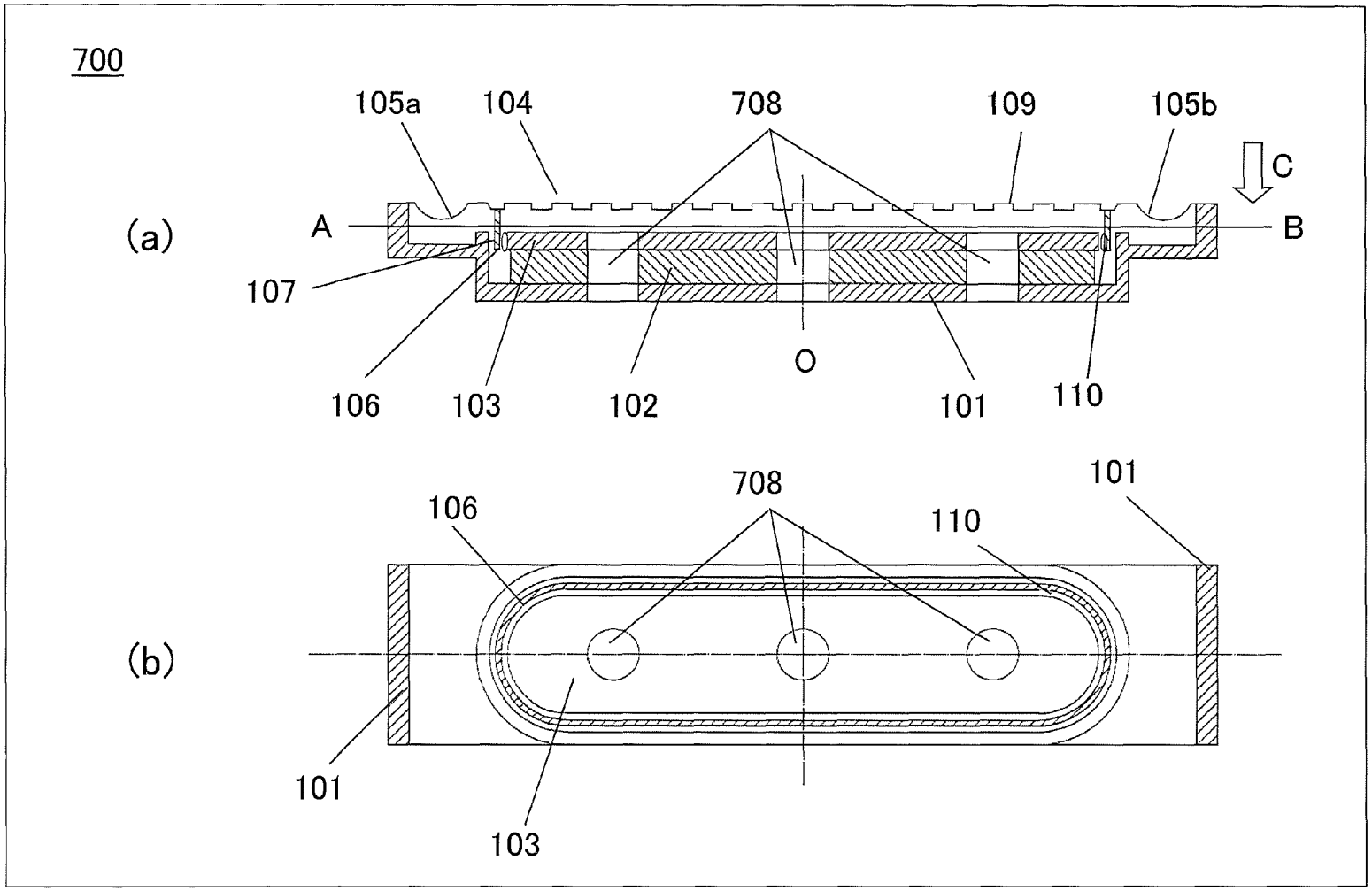
FIG. 4 is a diagram showing cross-sectional views of a loudspeaker according to a modification of the present disclosure.

Next, a loudspeaker device 700 as a modification of the present disclosure will be described with reference to FIG. 4. The loudspeaker device 700 is different from the loudspeaker device 100 in that the loudspeaker device 700 has sound holes 708. The sound holes 708 are three circular holes arranged side by side. These holes are easily designed, and cause the magnetic fluid 110 to be uniformly distributed in the magnetic gap formed on the inner side of the voice coil 106. The number of the holes is not limited to three. As described with reference to FIG. 3, in the case of the track-shaped loudspeaker, non-uniform distribution of the magnetic flux density prominently occurs at and in the vicinity of the boundary between the linear portion and the curved portion, and therefore, the sound holes may be provided such that the magnetic flux density in the linear portion (having a high magnetic flux density) in the vicinity of the boundary is reduced. That is, the present disclosure is applicable to other shapes than the track shape (e.g., shapes other than circular, such as oblong). Also in this case, the sound holes may be designed so as to reduce the magnetic flux density in a position where the magnetic flux density is high in an area where non-uniformity of magnetic flux density is prominent.

Figure 5:
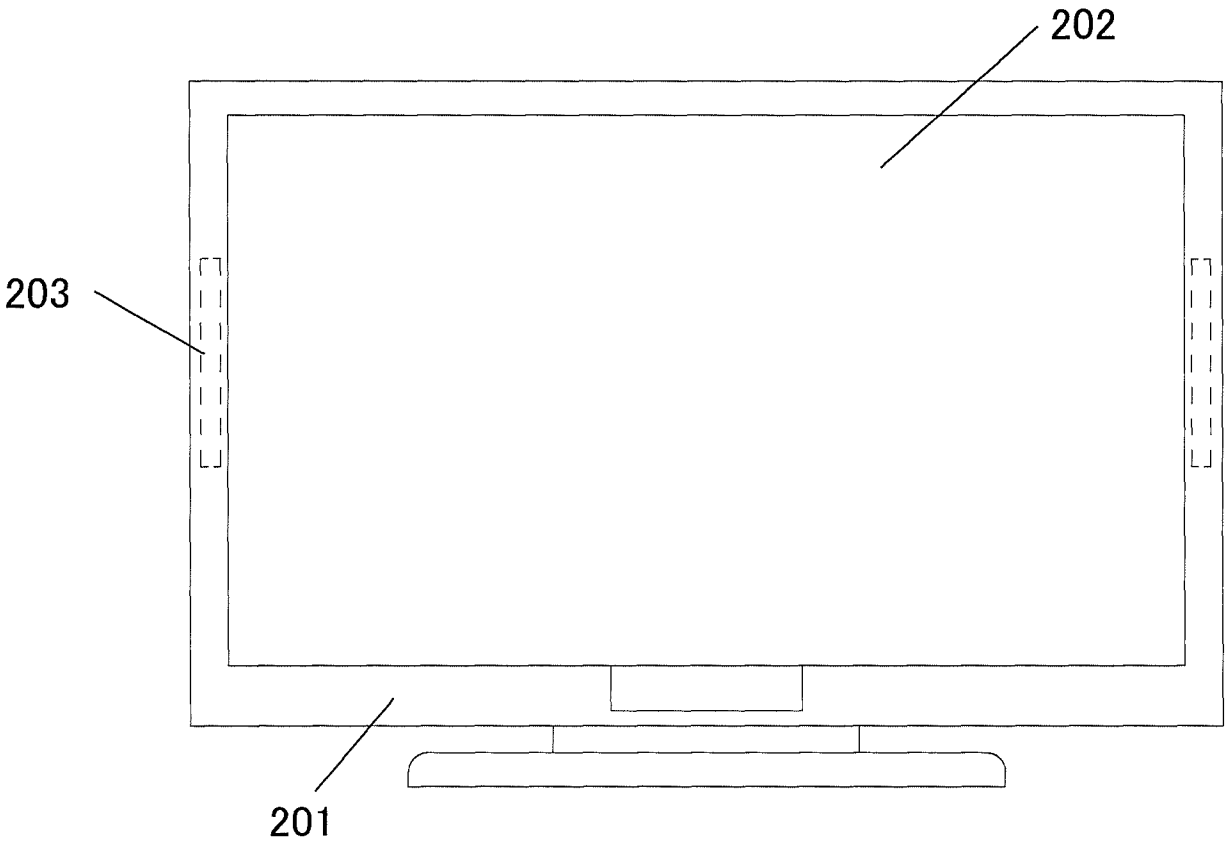
FIG. 5 is a diagram showing a front external view of a flat-screen television equipped with the loudspeaker according to the present disclosure.

Next, a case where the loudspeaker of the present disclosure is mounted in a flat-screen television set will be described. FIG. 5 is a diagram showing the configuration of a flat-screen television set in which the loudspeaker of the present disclosure is installed. FIG. 5 is an external front view of the flat-screen television set. In FIG. 5, reference numeral 201 denotes a housing of the television set, 202 denotes a display such as a PDP, a liquid crystal panel, or an organic EL panel, and 203 denotes a loudspeaker. The loudspeaker 203 is installed in the housing at both sides of the display 202. Any of loudspeakers 100, 300, 400, 500, and 700 according to the present disclosure may be adopted as the loudspeaker 203.

The operation of the flat-screen television set configured as described above will be described hereinafter. Although not shown in the figure, an acoustic signal processed in a signal processing unit is input to the right and left loudspeakers 203, and thereby sounds are reproduced from the loudspeakers 203. Although each loudspeaker 203 has a slim shape in accordance with the narrow frame design of the television set, since the sound hole is designed such that the magnetic flux density on the outer side surface of the plate is uniform, the magnetic fluid is uniformly distributed in the magnetic gap formed by the voice coil and the plate, thereby realizing a flat-screen television that is excellent in low-pitch sound reproduction while suppressing degradation in low-frequency characteristics and rolling due to an air hole. While in the present disclosure two loudspeakers are provided on the both sides of the display, the number of the loudspeakers and the locations thereof are not particularly limited.

Figure 6:
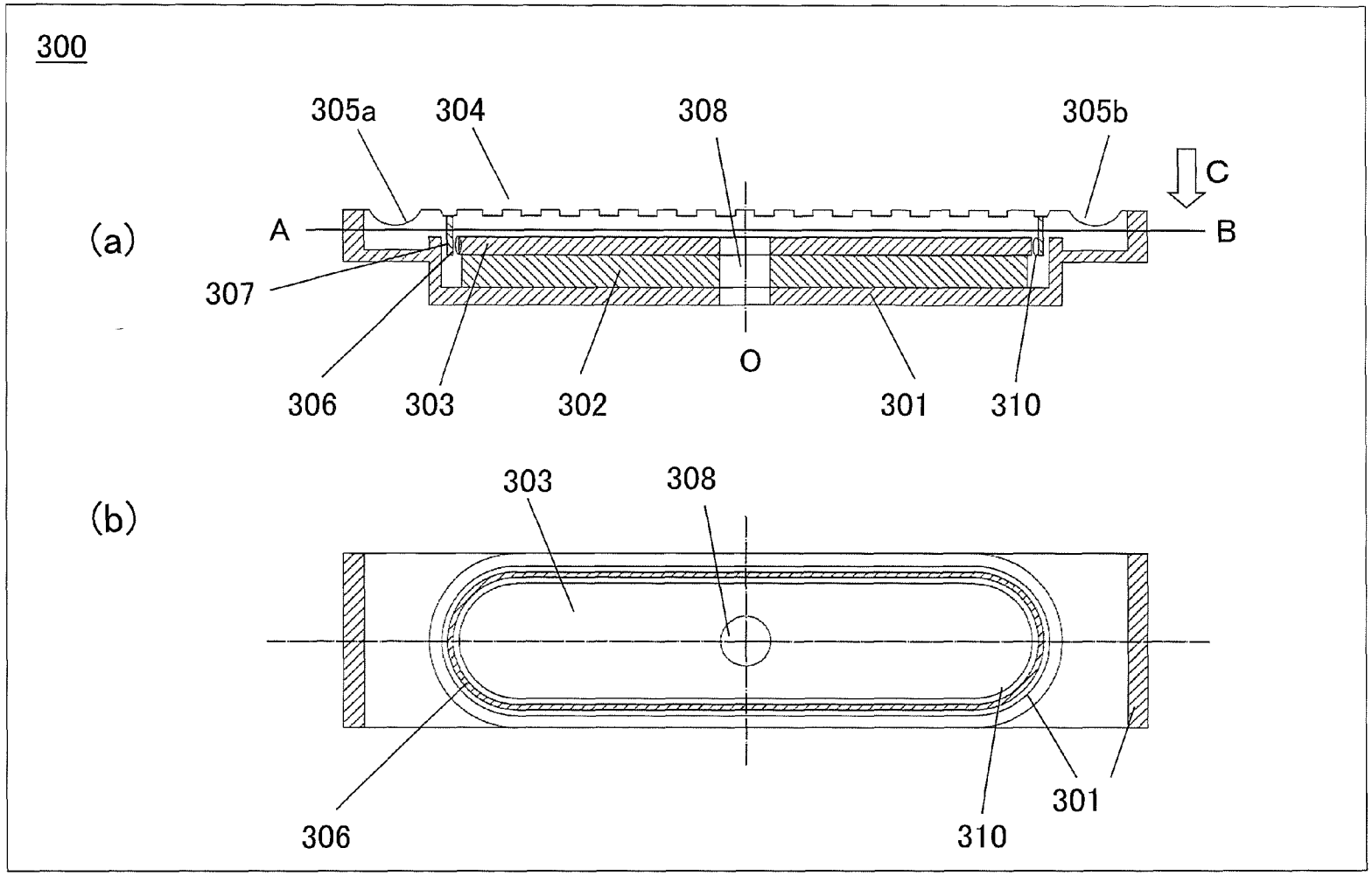
FIG. 6 is a diagram showing cross-sectional views of another loudspeaker according to the present disclosure.

FIG. 6 shows cross-sectional views of a loudspeaker 300 according to the present disclosure. The vertical direction, the horizontal direction, and the vibration direction are defined in the same manner as described above. FIG. 6(*a*) is a vertical cross-sectional view of the loudspeaker 300, and FIG. 6(*b*) is a cross-sectional view of the loudspeaker 300 taken along a line A-B in FIG. 6(*a*) and viewed in a direction of an arrow C. The loudspeaker 300 includes a yoke 301, a magnet 302, a plate 303, a diaphragm 304, suspensions 305*a* and 305*b*, a voice coil 306, a sound hole 308, and a magnetic fluid 310. The yoke 301, the magnet 302, and the plate 303 form a magnetic gap 307. The voice coil 306 and the magnetic fluid 310 are provided in the magnetic gap 307. The loudspeaker 300 is different from the loudspeaker 100 in that a bonded magnet is used as the magnet 302, and that the sound hole 308 is adopted. Hereinafter, the operation of the loudspeaker 300 will be described with respect to the components different from those of the loudspeaker 100.

The loudspeaker 300 is identical to the loudspeaker 100 in that the voice coil 306 vibrates and a sound wave is generated from the diaphragm 304. The loudspeaker 300 is greatly different from the loudspeaker 100 in that a bonded magnet is used as the magnet 302 (means to uniformly distribute the magnetic fluid). The bonded magnet is a flexible magnet obtained by grinding magnet and mixing resultant magnetic particles into rubber or plastic. The bonded magnet has a high degree of freedom in designing its shape and magnetizing direction. Therefore, use of the bonded magnet allows design of the magnetic flux density such that the magnetic fluid 310 is uniformly distributed in the magnetic gap formed on the inner side of the voice coil 306. Therefore, it is not necessary to provide a sound hole having a shape like the sound hole of the loudspeaker 100, and the same effect can be achieved even when a sound hole having a shape like the conventional sound hole is used. That is, it is possible to prevent an air gap from being generated between the plate 303 and the voice coil 306 due to the magnetic fluid being locally distributed, thereby avoiding degradation in low-frequency characteristics due to sound leakage, and rolling.

Further, when the magnetic fluid 310 is injected into the magnetic circuit in the assembly stage, the magnetic fluid 310 can be uniformly injected. Therefore, it is possible to prevent the magnetic fluid 310 from attaching to the inner side surface of the yoke 301. Further, a bonded magnet is easy to process. Accordingly, regarding sound waves emitted from the sound hole 308, the sound hole 308 can be freely designed in molding so as to prevent occurrence of interference of sound waves emitted from the center and the edge of the diaphragm, and thus interference due to a difference in path lengths can be suppressed. Accordingly, it is easy to form a plurality of circular sound holes as in the loudspeaker 700 shown in FIG. 4. Since the plurality of circular sound holes are provided, even when the loudspeaker has a slim shape, the loudspeaker can emit sound waves without degrading the low-frequency characteristics that are likely to be affected by interference due to a difference in path lengths.

As described above, in the present disclosure, it is possible to adopt the magnet whose magnetic flux density in the magnetic gap can be freely changed.

Figure 7:
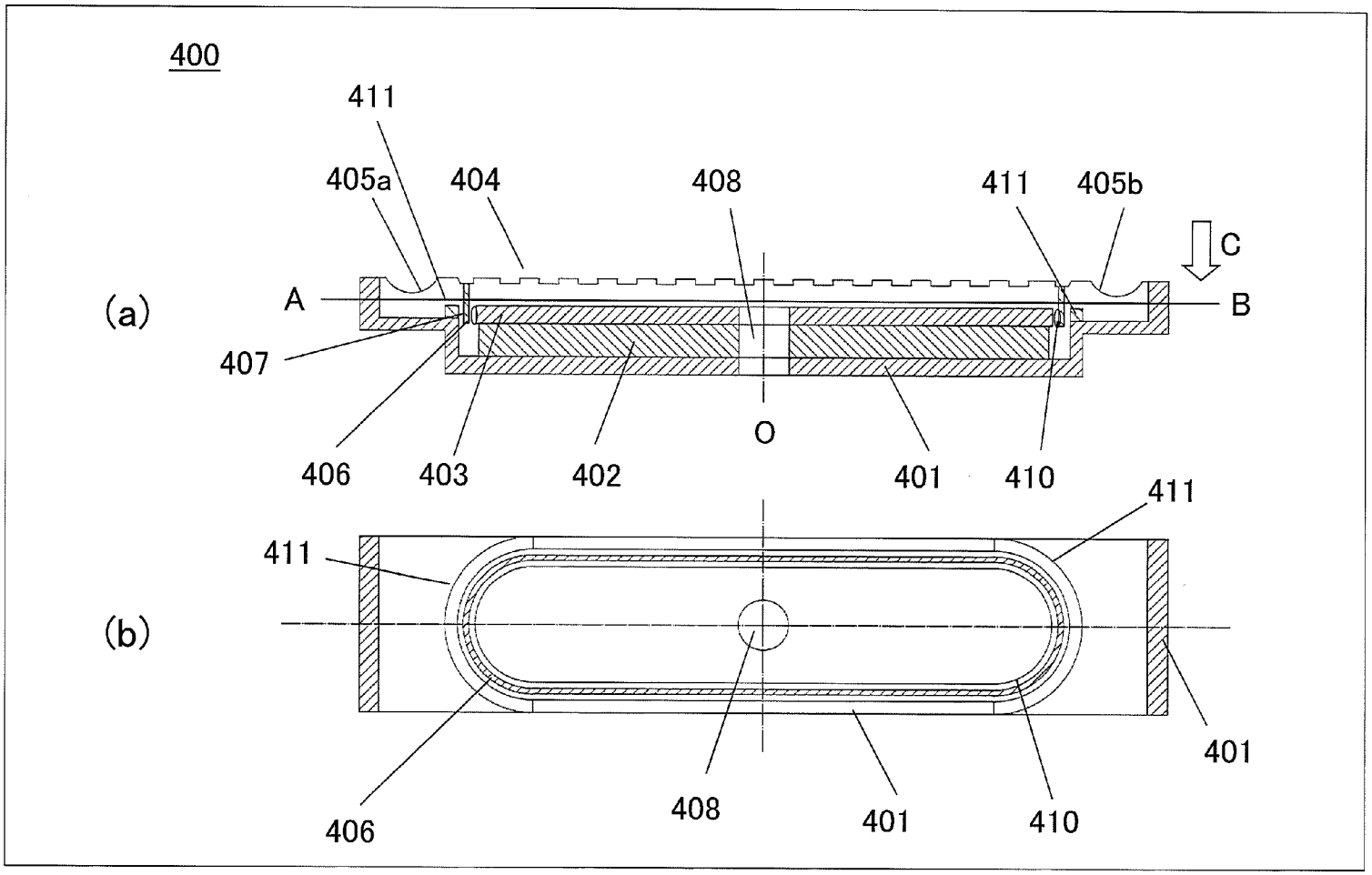
FIG. 7 is a diagram showing cross-sectional views of still another loudspeaker according to the present disclosure.

FIG. 7 shows a cross-sectional view of a loudspeaker 400 according to the present disclosure. The vertical direction, the horizontal direction, and the vibration direction are defined in the same manner as described above. FIG. 7(*a*) is a vertical cross-sectional view of the loudspeaker 400, and FIG. 7(*b*) is a cross-sectional view of the loudspeaker 400 taken along a line A-B in FIG. 7(*a*) and viewed in a direction of an arrow C. The loudspeaker 400 includes a yoke 401, a magnet 402, a plate 403, a diaphragm 404, suspensions 405*a* and 405*b*, a voice coil 406, a sound hole 408, a magnetic fluid 410, and auxiliary magnets 411. The loudspeaker 400 is different from the loudspeaker 100 in that the auxiliary magnets 411 are provided. Hereinafter, the operation of the loudspeaker 400 will be described with respect to the components different from those of the loudspeaker 100.

The loudspeaker 400 is identical to the loudspeaker 100 in that the voice coil 406 vibrates and a sound wave is generated from the diaphragm 404. The loudspeaker 400 is greatly different from the loudspeaker 100 in that the auxiliary magnets 411 (means to uniformly distribute the magnetic fluid) are bonded to both ends of the yoke 401 at both the short sides thereof. Since the size and shape of the auxiliary magnets 411 are adjusted so that the magnetic fluid 410 is uniformly held on the outer side surface of the plate 403, whereby the magnetic fluid 410 can be uniformly distributed in the magnetic gap formed on the inner side of the voice coil 406. Therefore, it is possible to prevent an air gap from being generated between the plate 403 and the voice coil 406 due to the magnetic fluid 410 being locally distributed, thereby avoiding degradation in low-frequency characteristics due to sound leakage, and rolling.

Further, when injecting the magnetic fluid 410 into the magnetic circuit in the assembling stage, the magnetic fluid 410 can be uniformly injected, thereby preventing the magnetic fluid 110 from attaching to the inner side surface of the yoke 401. Furthermore, in the present disclosure, the auxiliary magnets 411 can compensate for a shortage of the magnetic flux density in the curved portion of the magnetic gap 407. Therefore, it is possible to make the magnetic flux density distribution uniform without degrading the efficiency.

Figure 8:
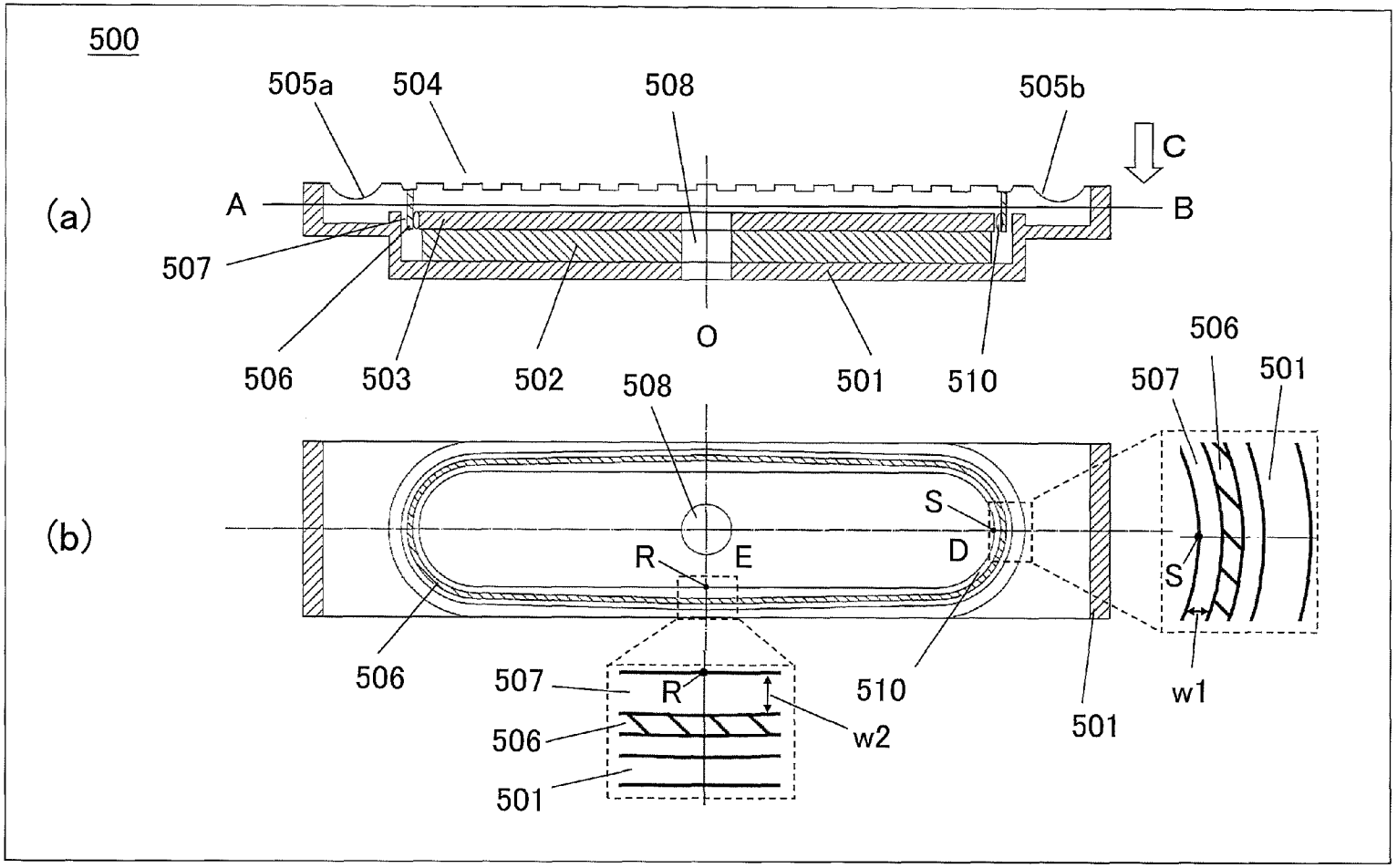
FIG. 8 is a diagram showing cross-sectional views of still another loudspeaker according to the present disclosure.

FIG. 8 shows a cross-sectional view of a loudspeaker 500 according to the present disclosure. The vertical direction, the horizontal direction, and the vibration direction are defined in the same manner as described above. FIG. 8(*a*) is a vertical cross-sectional view of the loudspeaker 500, and FIG. 8(*b*) is a cross-sectional view of the loudspeaker 500 taken along a line A-B in FIG. 8(*a*) and viewed in a direction of an arrow C. The loudspeaker 500 includes a yoke 501, a magnet 502, a plate 503, a diaphragm 504, suspensions 505*a* and 505*b*, a voice coil 506, a sound hole 508, and a magnetic fluid 510. The loudspeaker 500 is different from the loudspeaker 100 in the shape of the voice coil 506. Hereinafter, the operation of the loudspeaker 500 will be described with respect to the components different from those of the loudspeaker 100.

The loudspeaker 500 is identical to the loudspeaker 100 in that the voice coil 506 vibrates and a sound wave is generated from the diaphragm 404. The loudspeaker 500 is greatly different from the loudspeaker 100 in that the shape of the voice coil 506 (means to uniformly distribute the magnetic fluid) is changed in accordance with the distribution of the magnetic fluid 510. Specifically, in FIG. 8(*b*), since the magnetic flux density is higher in an area E corresponding to the linear portion of the track than in an area D corresponding to the curved portion of the track, a width w2 of a magnetic gap 507 in the area E is set to be larger than a width w1 of the magnetic gap 507 in the area D. Generally, assuming that, viewed in a penetration direction of a sound hole, a point on an outer circumference of a plate closest to the center of gravity of the sound hole is a third point (corresponding to point R in FIG. 8), a shortest distance between the third point and a voice coil is a third distance (corresponding to the width w2 in FIG. 8), a point on the outer circumference of the plate farthest from the center of gravity of the sound hole is a fourth point (corresponding to point S in FIG. 8), and a shortest distance between the fourth point and the voice coil is a fourth distance (corresponding to the width w1 in FIG. 8), the third distance is larger than the fourth distance. In this configuration, even when the magnetic fluid 510 is non-uniformly distributed on the outer side surface of the plate 503, since the voice coil 506 has a shape suited to the distribution of the magnetic fluid 510, it is possible to prevent an air gap from being generated in the magnetic gap 507 formed on the inner side of the voice coil 506, thereby avoiding degradation in low-frequency characteristics due to sound leakage, and rolling. While in the present disclosure the voice coil 506 has a change in its shape in the long side direction, the shape of the voice coil 506 may be changed in any way as long as the change in the shape is suited to the distribution of the magnetic fluid.

Embodiment 2

Hereinafter, further description will be given of a loudspeaker capable of uniformly distributing a magnetic fluid in a magnetic gap. The following description also relates to improvement in production efficiency of a small-sized loudspeaker capable of low-pitch sound reproduction as well as improvement in efficiency of the loudspeaker. In the following description, reference numerals given to respective components are independent of those in FIGS. 1 to 8 and FIG. 22.

In recent years, with the spread of mobile information terminals and the spread of living style in which individuals personally enjoy video and music, demands for inner-ear headphones with high sound quality are increasing. The shape of an auditory pore into which an inner-ear headphone is inserted greatly varies among users. Therefore, in order to improve wearing comfort for many users, a small-size loudspeaker with a high degree of freedom in case design is desired. In addition, a loudspeaker installed in a main body of a mobile information terminal is desired to have a wide frequency band for sound output and to be thin. An electrodynamic loudspeaker disclosed in Patent Literature 1 is proposed as an example of a loudspeaker that realizes space saving desired for the inner-ear headphone and the mobile information terminal, and is capable of low-pitch sound reproduction.

FIG. 23 is a diagram showing cross-sectional views of a loudspeaker 1100 disclosed in Patent Literature 1. In FIG. 23, FIG. 23(*a*) is a top view of the loudspeaker 1100. FIG. 23(*b*) is a cross-sectional view of the loudspeaker 1100 taken along a line A-O-B in FIG. 23(*a*) and viewed in an arrow direction. As shown in FIG. 23, the loudspeaker 1100 of Patent Literature 1 includes a yoke 1101, a magnet 1102, a plate 1103, a diaphragm 1106, edge pieces 1108*a* to 1108*d*, a spacer 1109, a voice coil 1107, and a magnetic fluid 1110. The magnetic fluid 1110 is filled on an inner circumference side of the voice coil 1107 in a magnetic gap G2. According to the disclosure of Patent Literature 1, since a support member that supports the diaphragm 1106 in a vibratable manner is composed of the plurality of edge pieces 1108*a* to 1108*d*, even if the loudspeaker 1100 is reduced in size, it is possible to cause the diaphragm 1106 to operate with a large amplitude by reducing the stiffness of the support member. Further, since the magnetic fluid 1110 is filled on the inner circumference side of the voice coil 1107 in the magnetic gap G2, a sound wave emitted from a back surface of the diaphragm 1106 is prevented from leaking to a front surface of the diaphragm 1106 via the magnetic gap G2 and canceling out a sound wave emitted from the front surface of the diaphragm 1106, thereby improving the sound pressure.

As described above, according to the disclosure of Patent Literature 1, it is possible to extend the low-pitch sound range while reducing the size of the loudspeaker. On the other hand, in the space-saving type electrodynamic loudspeaker, a wiring space for lead wires that connect the voice coil to external terminals is narrow, and therefore, there is a high risk of abnormal noise and disconnection due to the lead wires contacting other components during operation. Further, a copper wire having a relatively small diameter is used as the voice coil of the space-saving type electrodynamic loudspeaker for the purpose of weight reduction, and therefore, there is a high risk of disconnection due to the copper wire being bent during assembling.

In order to avoid the above drawbacks, there has been proposed a configuration in which a slit-shaped cutout is formed in a side surface of a yoke to let a lead wire pass through the cutout, so as to make a voice coil vibratable with the lead wire being not in contact with other components. FIG. 24 is a cross-sectional view of a loudspeaker device 1 disclosed in Patent Literature 2. The loudspeaker device 1 includes a yoke 21, a plate 23, a vibrator 3, a voice coil 33, lead wires 4, a frame 5, and a terminal part 6. A pair of lead wires 4 is pulled out of the voice coil 33. Further, as shown in FIG. 24, the yoke 21 has a cutout 71 formed in a side portion 21C thereof. The lead wire 4 is pulled out of a lower end portion of the voice coil 33 in the vicinity of the cutout 71, passes through the cutout 71, and is electrically connected, at its end, to the terminal part 6 formed in the frame 5. Thereby, even if the voice coil 33 is displaced in the vertical direction, the lead wire 4 is prevented from contacting other components such as the yoke 21 and an edge 32. As described above, according to the disclosure of Patent Literature 2, it is possible to provide a thin loudspeaker or a small loudspeaker in which a voice coil is vibratable with a lead wire being not in contact with other components.

Hereinafter, the present disclosure will be described with reference to the drawings.

Figure 9:
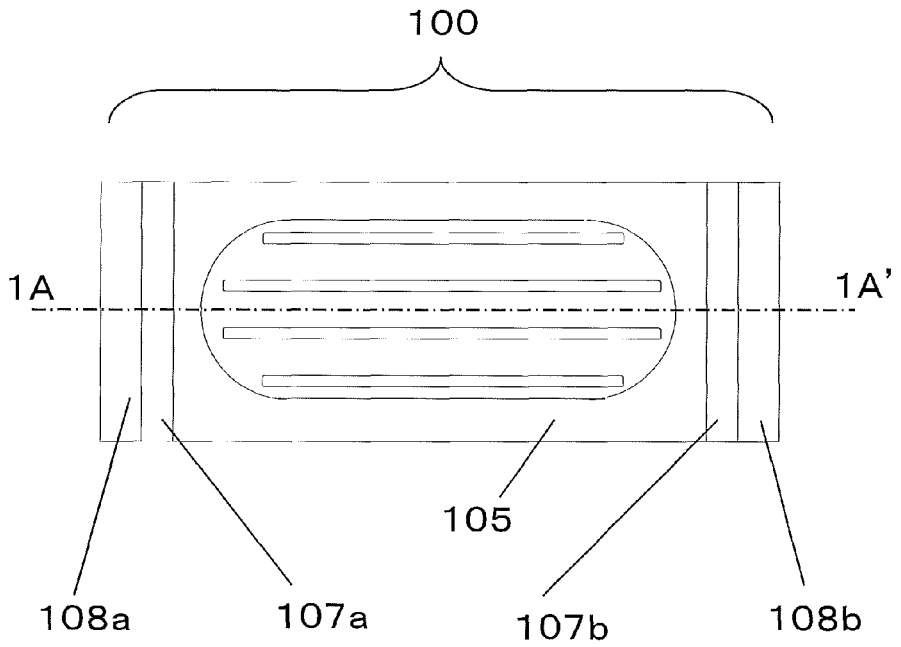
FIG. 9 is a diagram showing a top view of still another loudspeaker according to the present disclosure.
Figure 10:
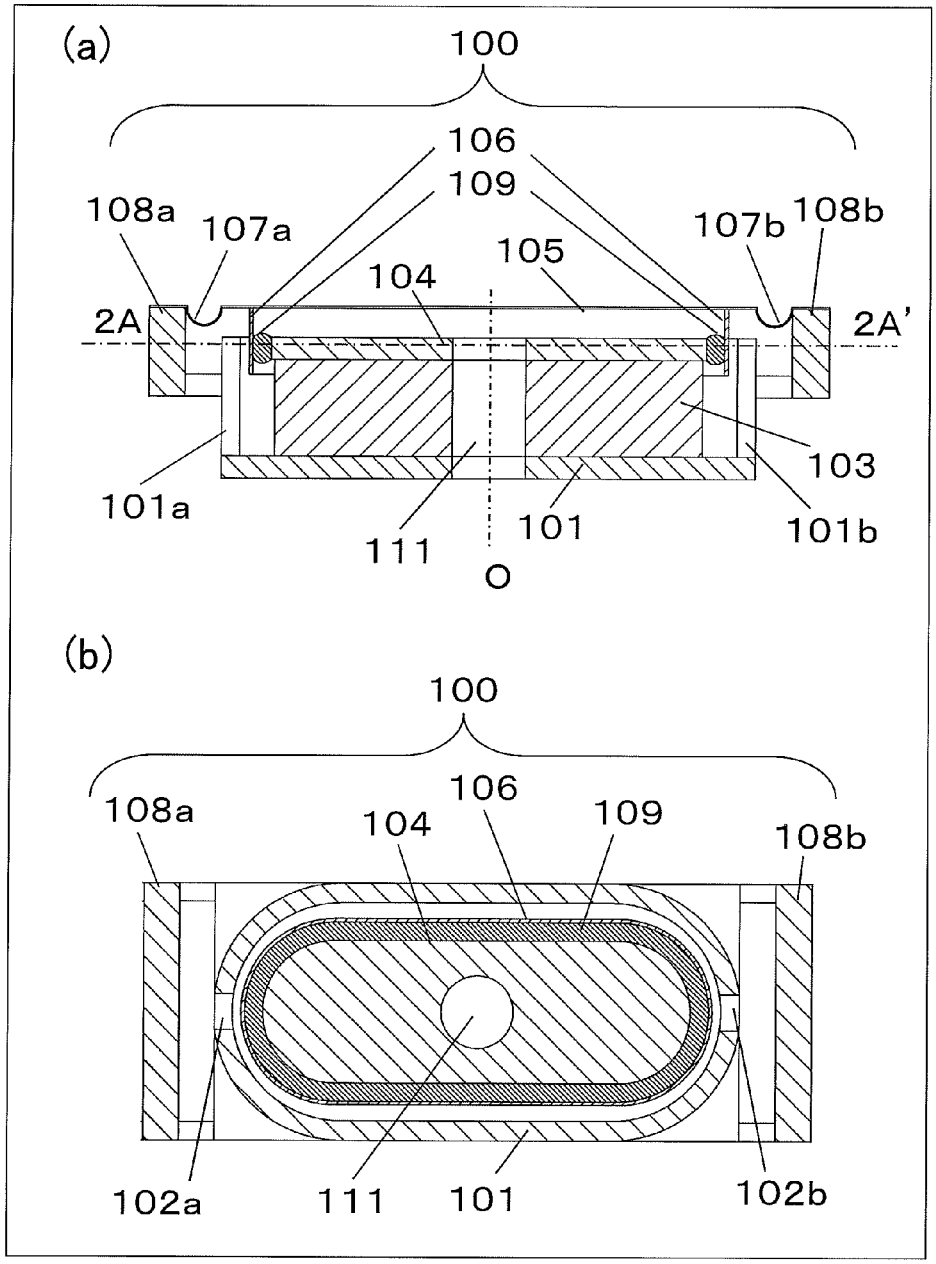
FIG. 10 is a diagram showing cross-sectional views of the loudspeaker shown in FIG. 9.
Figure 11:
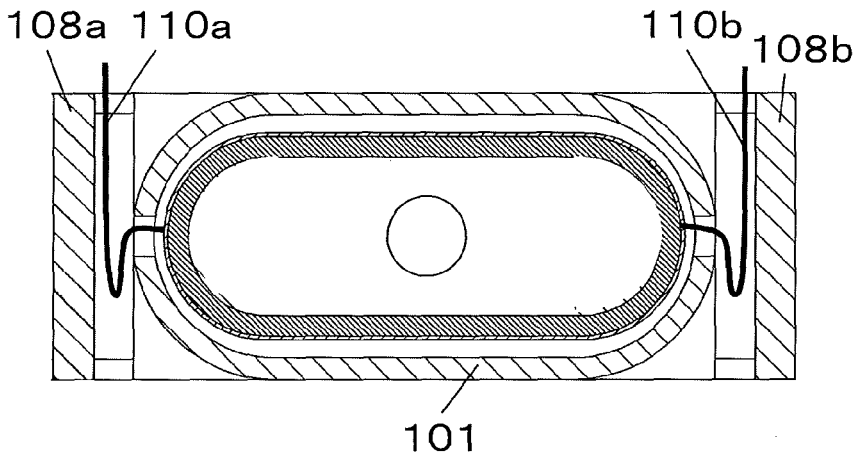
FIG. 11 is a diagram showing an arrangement of lead parts.

A configuration of a loudspeaker 100 according to the present disclosure will be described with reference to FIGS. 9 to 11. FIG. 9 is a top view of the loudspeaker 100. FIG. 10(*a*) is a cross-sectional view of the loudspeaker 100 taken along a line 1A-1A' in FIG. 9. FIG. 10(*b*) is a cross-sectional view of the loudspeaker 100 taken along a line 2A-2A' in FIG. 10(*a*). In FIG. 10(*a*), the loudspeaker 100 includes a yoke 101, a magnet 103, a plate 104, a diaphragm 105, a voice coil 106, suspensions 107*a* and 107*b*, frames 108*a* and 108*b*, and a magnetic fluid 109. The yoke 101 has a box-like shape with an upper surface being opened, and has cutouts 102*a* and 102*b*. The outer shape of the loudspeaker 100 viewed from the top is an elongated rectangular shape as shown in FIG. 9. The overall shape of the diaphragm 105 is an elongated rectangular shape, and ribs are provided inside a portion thereof to be fixed to the voice coil 106. The ribs are not essential components. Further, the outer shape of a magnetic circuit of the loudspeaker 100 viewed from the top is, as shown in FIG. 10(*b*), a substantially elliptic shape composed of semi-circular portions and linear portions. The voice coil 106 is provided in a gap formed between an inner circumference of a side portion 101*a*, 101*b* of the yoke 101 and an outer circumference of the plate 104 so as to be vibratable in the vertical direction. The shape of the voice coil 106 viewed from the top is a substantially elliptical shape. Further, the voice coil 106 has leads 110*a* and 110*b* as shown in FIG. 11.

A lower surface of the magnet 103 is fixed to an inner bottom surface of the yoke 101 as shown in FIG. 10(*a*). The plate 104 is fixed to an upper surface of the magnet 103. The upper surface of the magnet 103 serves as one of a pair of polar surfaces of the magnet 103 while the lower surface of the magnet 103 serves as the other polar surface of the magnet 103. Between the side portion 101*a*, 101*b* of the yoke 101 and the plate 104, a cylindrical magnetic gap having a substantially elliptical cross section is formed. The voice coil 106 is provided in the magnetic gap so as to be vibratable in a direction of a center axis O which is the vertical direction. The magnetic fluid 109 is filled between the plate 104 and the voice coil 106, and distributed in a substantially elliptical ring shape as viewed from the top. Generally, the magnetic fluid 109 may be filled in at least one of the gap between the voice coil 106 and the plate 104 and the gap between the voice coil 106 and the yoke 101. A through hole 111 along the center axis O is formed by holes formed penetrating the yoke 101, the magnet 103, and the plate 104. A peripheral edge of the diaphragm 105 is connected to an upper surface of the voice coil 106. The suspension 107*a* connects a left edge side of the diaphragm 105 to the frame 108*a*, and the suspension 107*b* connects a right edge side of the diaphragm 105 to the frame 108*b*. The cross-sectional shape of the suspension 107*a*, 107*b* is a curved line shape protruding downward as shown in FIG. 10(*a*).

Like the above-mentioned shapes of the yoke 101 and the plate 104, the shape of the inner edge of the outer side magnetic pole of the magnetic circuit with respect to the voice coil 106 and the shape of the outer edge of the inner side magnetic pole of the magnetic circuit with respect to the voice coil 106 are each composed of, as viewed from the top, two substantially linear portions opposed to each other, and two curved portions opposed to each other and protruding outward. The yoke 101 has, in the curved portions, two slits through which the lead wires of the voice coil 106 are taken out of the magnetic circuit.

The operation of the loudspeaker 100 configured as described above will be described. When an electric signal is input to the voice coil 106, the voice coil 106 vibrates in accordance with the Fleming's left-hand rule. Since the diaphragm 105 is connected to the voice coil 106, the diaphragm 105 vibrates with the vibration of the voice coil 106, and causes a pressure change in the air above and beneath the diaphragm 105, thereby generating a sound wave. By using either the upper surface or the lower surface of the loudspeaker as a sound emitting surface, auditory hearing is realized.

The magnetic fluid 109 is filled between the plate 104 and the voice coil 106, and is held by a magnetic field generated by the yoke 101, the magnet 103, and the plate 104, thereby blocking sound waves of opposite phases which are generated at the upper surface and the lower surface of the loudspeaker 100 to prevent the sound wave generated at the lower surface from reaching the upper surface. Thus, reduction in the reproduced sound pressure is avoided. As shown in FIG. 11, the leads 110*a* and 110*b* of the voice coil 106 pass through the cutouts 102*a* and 102*b* of the yoke 101, respectively, and are bent so as to be prevented from contacting the frames 108*a* and 108*b* and the yoke 101, and finally are electrically connected to external terminals (not shown).

Figure 12:
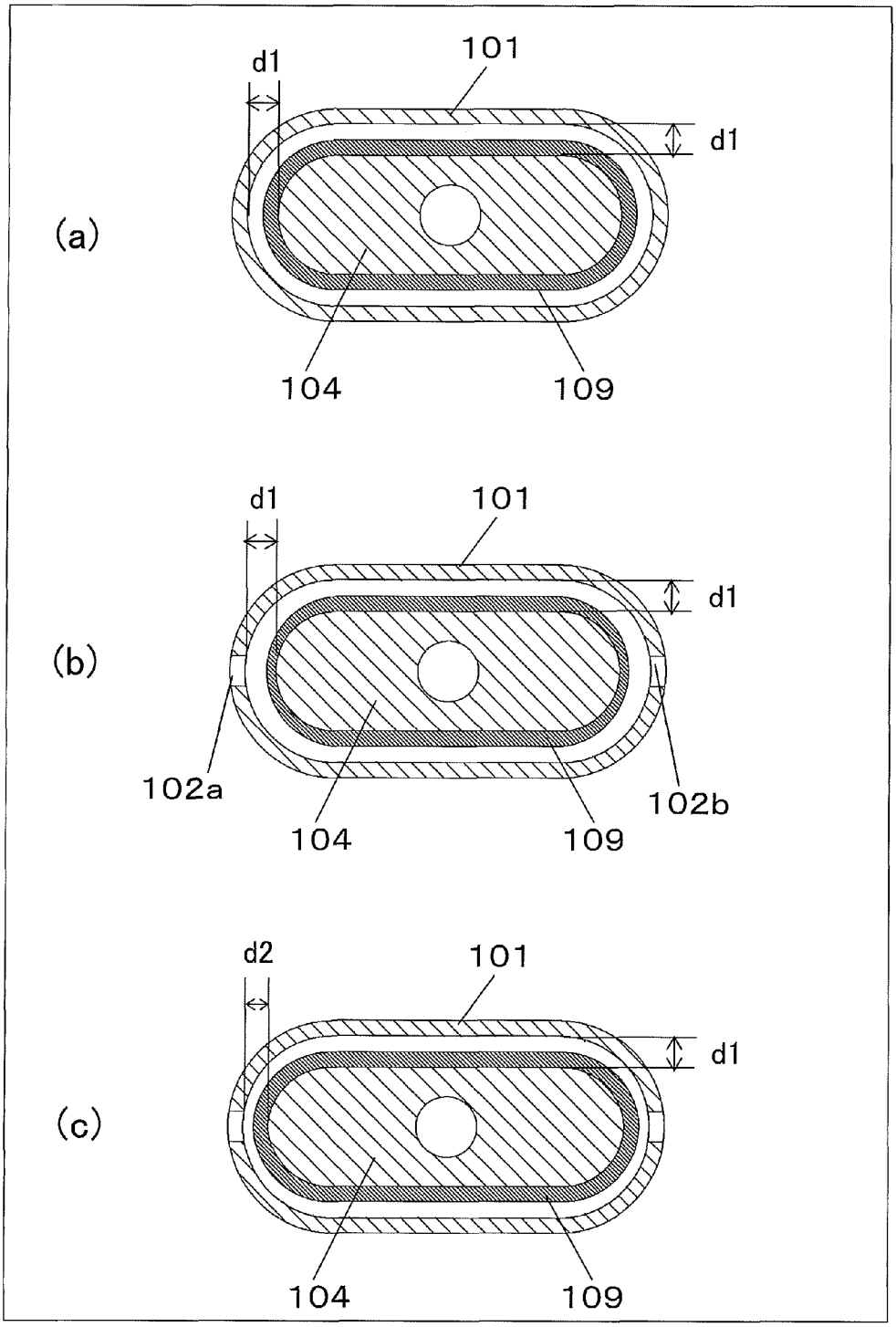
FIG. 12 is a diagram showing the state where a magnetic fluid is held.

The relationship between the shapes of the yoke 101 and the plate 104 and the magnetic fluid 109 will be described with reference to FIG. 12. FIGS. 12(*a*) to 12(*c*) are diagrams in which the components other than the yoke 101, the plate 104, and the magnetic fluid 109 are omitted from the loudspeaker 100. Among FIGS. 12(*a*) to 12(*c*), FIG. 12(*c*) shows the loudspeaker 100. It is assumed that a distance between the inner circumference of the yoke 101 and the outer circumference of the plate 104 in FIGS. 12(*a*) and 12(*b*) is d1, and a distance between the inner circumference of the yoke 101 and the outer circumference of the plate 104 in the vicinity of the cutout 102*a*, 102*b* is d2.

It is assumed that, when the yoke 101 has no cutouts 102*a* and 102*b*, the yoke 101 and the plate 104 have the shapes shown in FIG. 12(*a*) and the magnetic fluid 109 is uniformly distributed around the plate 104. If cutouts 102*a* and 102*b* are formed in the circular arc portions of the yoke 101 with the shapes of the yoke 101 and the plate 104 being unchanged, the magnetic gap between the yoke 101 and the plate 104 is increased in the vicinity of the cutout 102*a*, 102*b*, and thus the magnetic flux density is reduced. Therefore, the amount of the magnetic fluid 109 held in the vicinity of the cutout 102*a*, 102*b* shown in FIG. 12(*b*) is smaller than the amount of the magnetic fluid 109 held in other areas. As a result, air leakage might occur due to insufficient filling of the magnetic fluid 109 between the voice coil 106 and the plate 104, which might cause reduction in the sound pressure of the loudspeaker 100. Even if such air leakage does not occur, since distribution of the magnetic fluid 109 is non-uniform, the effect of holding the voice coil 106 at a predetermined position by the surface tension of the magnetic fluid is weakened, which might cause rolling or the like. Further, since the electromagnetic force that acts on the voice coil 106 is also reduced at the cutout 102*a*, 102*b*, rolling or the like might occur, and the efficiency of the loudspeaker 100 might be reduced.

On the other hand, the outer circumference of the semicircular portion of the plate 104 is closer to the inner circumference of the yoke 101 in FIG. 12(*c*) than in FIGS. 12(*a*) and 12(*b*). That is, the distance d2 between the inner circumference of the yoke 101 and the outer circumference of the plate 104 in the vicinity of the cutout 102*a*, 102*b* is smaller than the distance d1 as shown in FIG. 12(*c*). As a result, the magnetic flux density is not reduced even in the vicinity of the cutout 102*a*, 102*b*, and the magnetic fluid 109 is uniformly held over the entire circumference. Accordingly, it is possible to avoid reduction in the sound pressure of the loudspeaker 100 due to air leakage, rolling, and reduction in efficiency, which might occur in the configuration shown in FIG. 12(*b*).

Therefore, according to the loudspeaker 100, the distance between the inner circumference of the yoke and the outer circumference of the plate in the vicinity of the cutout 102*a*, 102*b* is smaller than that in other areas, thereby providing a small and thin loudspeaker with improved reliability and low-pitch sound reproduction ability, which realizes both prevention of contact of the lead wires to other components and uniform holding of the magnetic fluid. As described above, the width of the gap between the inner edge of the outer magnetic pole and the outer edge of the inner magnetic pole is smaller between the curved portions of the outer magnetic pole and the inner magnetic pole than between the linear portions thereof. The above configuration has an effect of making distribution of the magnetic fluid uniform. That is, the above configuration can be effectively applied not only to the loudspeaker having the cutouts but also to a loudspeaker having no cutouts. That is, the above configuration resolves not only the problem described in the present embodiment but also the problem described in Embodiment 1 when adopted to a loudspeaker having no cutouts.

Further, according to the loudspeaker 100, the suspensions 107*a* and 107*b* are separated in the long axis direction. That is, the suspensions do not cover the entire circumference of the diaphragm. Therefore, the length of the loudspeaker 100 in the short axis direction can be reduced to the length of the yoke 101 in the short axis direction, thereby providing a narrow loudspeaker capable of wideband reproduction.

Further, since the lead 110*a*, 110*b* of the voice coil 106 is arranged in a space between the yoke 101 and the frame 108*a*, 108*b* and beneath the suspension 108*a*, 108*b*, respectively, it is not necessary to provide spaces for the leads 110*a* and 110*b*. Accordingly, it is possible to configure a space saving type loudspeaker with the voice coil 106 being vibratable.

Figure 13:
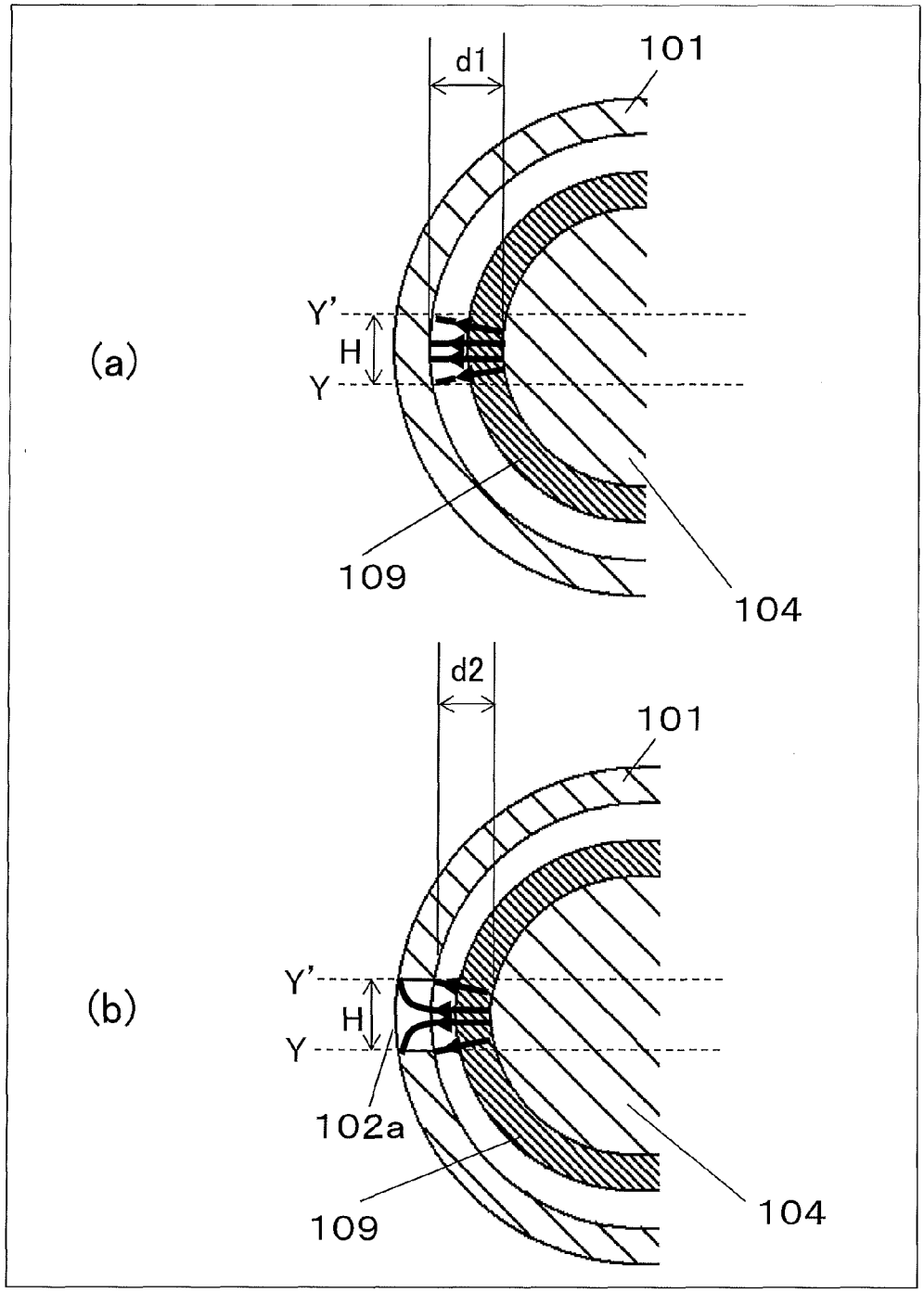
FIG. 13 is a diagram showing magnetic flux distribution.

In order to effectively achieve the object of the present disclosure, the shapes of the cutout 102*a*, 102*b* of the yoke 101 and the plate 104 may be specifically determined by the following method. FIG. 13 shows magnetic flux distribution (b) that causes a magnetic circuit in the vicinity of the cutout 102*a* in comparison with magnetic flux distribution (a) in a case where the yoke 101 has no cutouts 102*a* and 102*b*. For ease of description, it is assumed that the magnetic circuit has an N pole at the plate 104 side and an S pole at the yoke 101 side. The width of the cutout 102*a* is equal to a height H in a range of Y-Y'. In the range of Y-Y' shown in FIGS. 13(*a*) and 13(*b*), the density per unit area of magnetic flux passing the voice coil is inversely proportional to the square of the average length of magnetic flux lines each having a starting end at the plate 104 side and a terminating end at the yoke 101 side. That is, by setting the d2 such that the average length of the magnetic flux lines in the range of Y-Y' is equal to the average length of the magnetic flux lines in the case where the yoke has no cutout, it is possible to make the magnetic flux density in the vicinity of the cutout 102*a* equal to the magnetic flux density in the case where the yoke has no cutout.

When the yoke 101 has no cutout, the average length of the magnetic flux lines may be regarded to be the distance d1 between the inner wall of the yoke 101 and the outer circumference of the plate 104 as shown in FIG. 13(*a*). When the yoke 101 has the cutouts 102*a* and 102*b*, as shown in FIG. 13(*b*), the average length of the magnetic flux lines has a value d2' that is larger than the distance d2 between the inner wall of the yoke 101 and the outer circumference of the plate 104, and the value d2' varies depending on the width H of the cutout 102*a*. Practically, the distribution of the magnetic flux lines is approximated by a secondary curve such as an arc of an ellipse, the range of Y-Y' is divided into a plurality of small regions, and an average length of magnetic flux lines passing each of the small regions is calculated.

While in the loudspeaker 100 the overall shape of the diaphragm 105 is an elongated rectangular shape, the shape of the diaphragm 105 may be a substantially elliptic shape that is substantially equal to the shape of the magnetic circuit, that is, may be a shape obtained by cutting out corner portions of the elongated rectangular shape. This shape of the diaphragm allows the leads 110*a* and 110*b* to be extended to where the corner portions have been cut out, and thus the range where the diaphragm 105 is vertically vibratable without contacting the leads 110*a* and 110*b* can be extended.

Further, while the ribs of the diaphragm 105 are provided inside the portion of the diaphragm 105 to be fixed to the voice coil 106, the ribs may be provided on the corner portions of the elongated rectangular shape. Further, while the shape of the diaphragm 105 is a planar shape having the ribs, the shape of the diaphragm 105 may be a dome shape having a protruding center portion. These shapes of the diaphragm increase the rigidity of the diaphragm 105, and thereby avoiding reduction in the sound pressure due to divided vibration, and providing a loudspeaker having excellent output frequency characteristics in the higher frequency band.

Further, while the outer shape of the magnetic circuit part viewed from the top is a substantially elliptic shape composed of semi-circular portions and linear portions, the shape of the magnetic circuit part may be a substantially elongated rectangular shape having arc-shaped corner portions. According to this configuration, the volume of the magnet 103 can be further increased within the shape of the loudspeaker 100, thereby providing a highly efficient loudspeaker.

Further, the leads 110*a* and 110*b* of the voice coil 106 are not necessarily pulled out toward the long side of the loudspeaker 100 as shown in FIG. 11, but may be extended to the spaces beneath the frames 108*a* and 108*b* and pulled out toward the short side of the loudspeaker 100. According to the present disclosure, a variety of arrangements of lead wires can be realized without changing the shape of the magnetic circuit. Further, since the direction of the voice coil 106 can be stably maintained by the holding power of the magnetic fluid 109, even if the leads 110*a* and 110*b* are arranged asymmetrically with respect to the voice coil 106, it is possible to reduce the risk of rolling and reduction in efficiency due to the tensions of the lead wires being biased. Therefore, according to the present disclosure, it is possible to increase the number of options of the feed directions of the terminal parts without changing the shapes of the components, thereby providing a highly customizable loudspeaker at low costs.

Further, the cutouts 102*a* and 102*b* are not necessarily formed at positions on the long axis of the loudspeaker 100, and may be formed at any positions on the semi-circular portions of the yoke 101. For example, when the cutout 102*a*, 102*b* is formed between one end of the semi-circular portion of the yoke 101 and the center point thereof, the leads 110*a* and 110*b* of the voice coil 106 can be brought close to the long side of the loudspeaker 100, thereby reducing the risk of contact of the lead wires 110*a* and 110*b* to the suspensions 107*a* and 107*b*, the frames 108*a* and 108*b*, and the yoke 101, respectively.

Further, in the loudspeaker 100, the shape of the cutout 102*a*, 102*b* is a slit shape extending from the upper surface of the yoke 101 to the inner bottom thereof. However, the shape of the cutout is not limited thereto. For example, the lower end of the cutout 102*a*, 102*b* may be extended to the outer bottom of the yoke 101. In this case, the cutout 102*a*, 102*b* can be easily formed by cutting the yoke 101 from its side surface by using cutting means, thereby reducing the machining cost. Alternatively, a filler may be applied on the cutouts 102*a* and 102*b*. In this case, it is possible to prevent the leads 110*a* and 110*b* from protruding over the yoke due to an impact such as a fall.

Further, in the loudspeaker 100, the distance between the outer circumference of the plate 104 and the inner circumference of the yoke 101 in the vicinity of the cutout 102*a*, 102*b* is reduced by changing only the shape of the plate 104. However, the inner circumference of the semi-circular portion of the yoke 101 may be brought close to the plate 104, or the shapes of the yoke 101 and the plate 104 may be changed.

Further, instead of providing a slit as a cutout, a through hole may be formed in the side wall of the yoke 101 so as to have a predetermined clearance at each of upper and lower limits of a swing of the lead wires.

Figure 14:
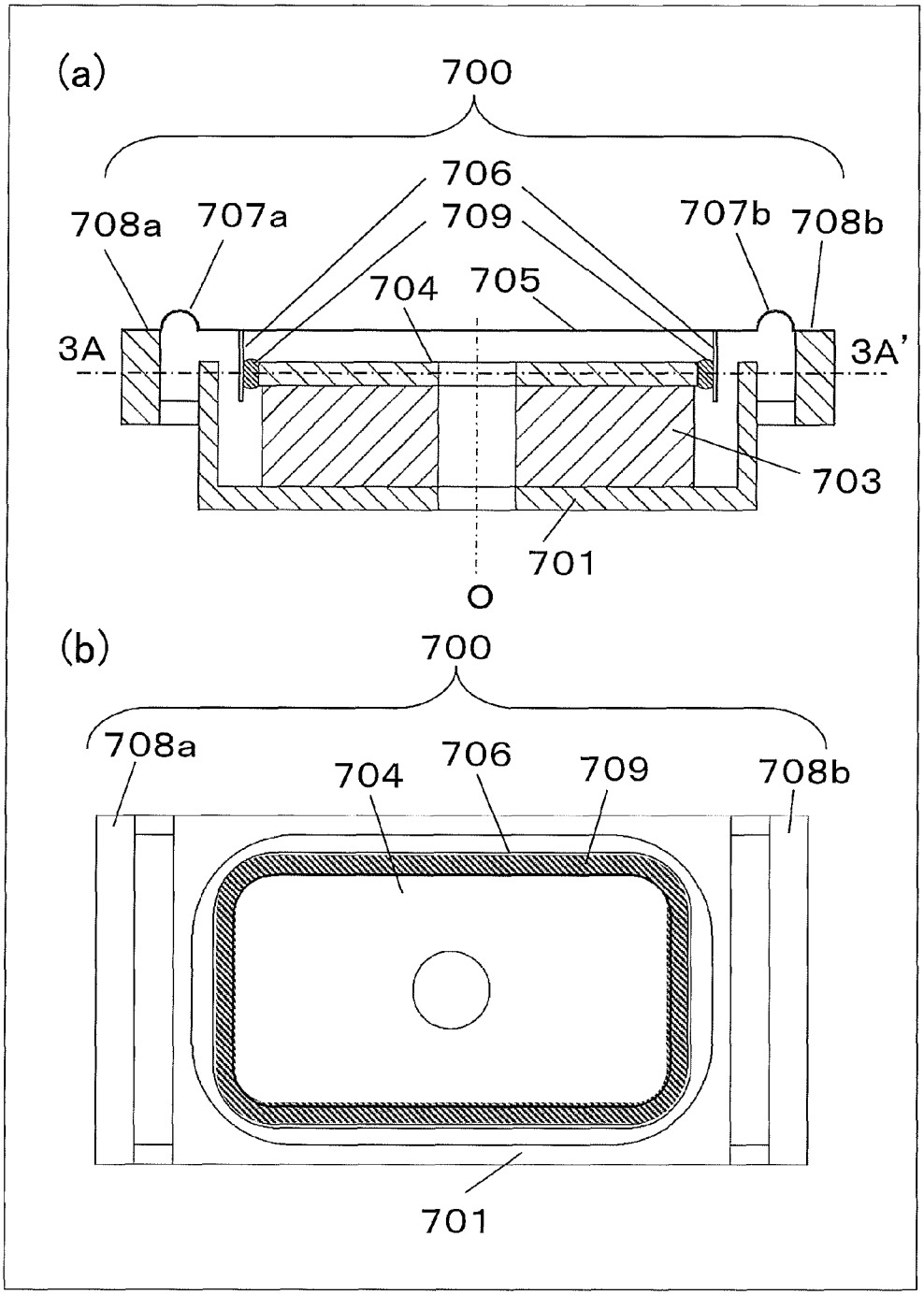
FIG. 14 is a diagram showing cross-sectional views of still another loudspeaker according to the present disclosure.
Figure 15:
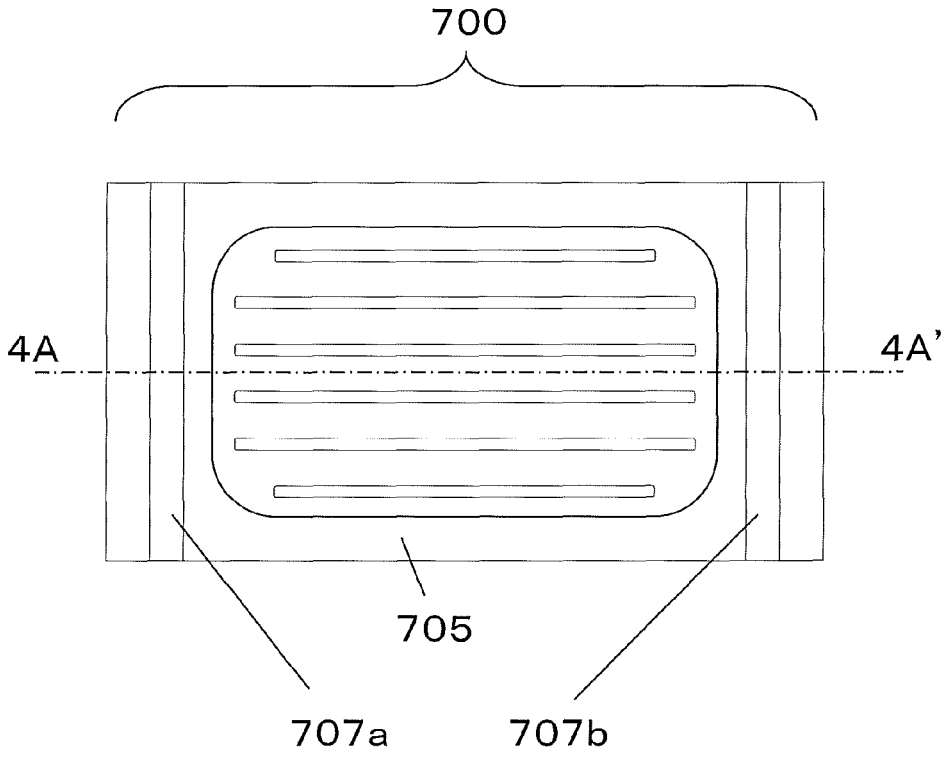
FIG. 15 is a diagram showing a top view of the loudspeaker shown in FIG. 14.

The configuration of a loudspeaker 700 according to the present disclosure will be described with reference to FIGS. 14 and 15. FIG. 15 is a top view of the loudspeaker 700. FIG. 14(*a*) is a cross-sectional view of the loudspeaker 700 taken along a line 4A-4A' in FIG. 15, and FIG. 14(*b*) is a cross-sectional view of the loudspeaker 700 taken along a line 3A-3A' in FIG. 14(*a*). The loudspeaker 700 includes a yoke 701, a magnet 703, a plate 704, a diaphragm 705, a voice coil 706, suspensions 707*a* and 707*b*, suspension bonding platforms 708*a* and 708*b*, and a magnetic fluid 709. The voice coil 706 includes leads (not shown) similar to those described above. The outer shape of the loudspeaker 700 viewed from the top is a substantially oblong shape as shown in FIG. 15. The outer shape of the magnet 703, the plate 704, and the voice coil 706 is a substantially rectangular shape such as an oblong shape having rounded corners. The outer shape of the yoke 701 and the diaphragm 705 is a substantially rectangular shape such as an oblong shape having rounded corners.

The positional relationship and the contact relationship among the yoke 701, the magnet 703, the plate 704, the diaphragm 705, the voice coil 706, and the magnetic fluid 709 are identical to those described with reference to FIGS. 9 to 13 except that the yoke 701, the magnet 703, the plate 704, the diaphragm 705, and the voice coil 706 each have a substantially oblong shape, and that the yoke 701 has no cutout. The yoke 701 may have cutouts as described above.

The operation of the loudspeaker 700 configured as described above is identical to the operation of the loudspeaker 100.

Figure 16:
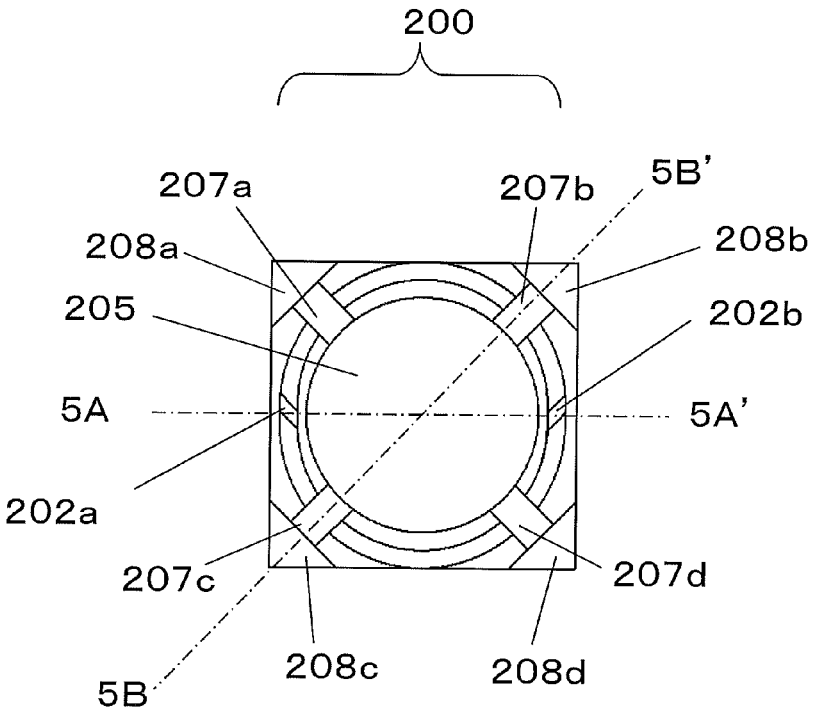
FIG. 16 is a diagram showing a top view of still another loudspeaker according to the present disclosure.
Figure 17:
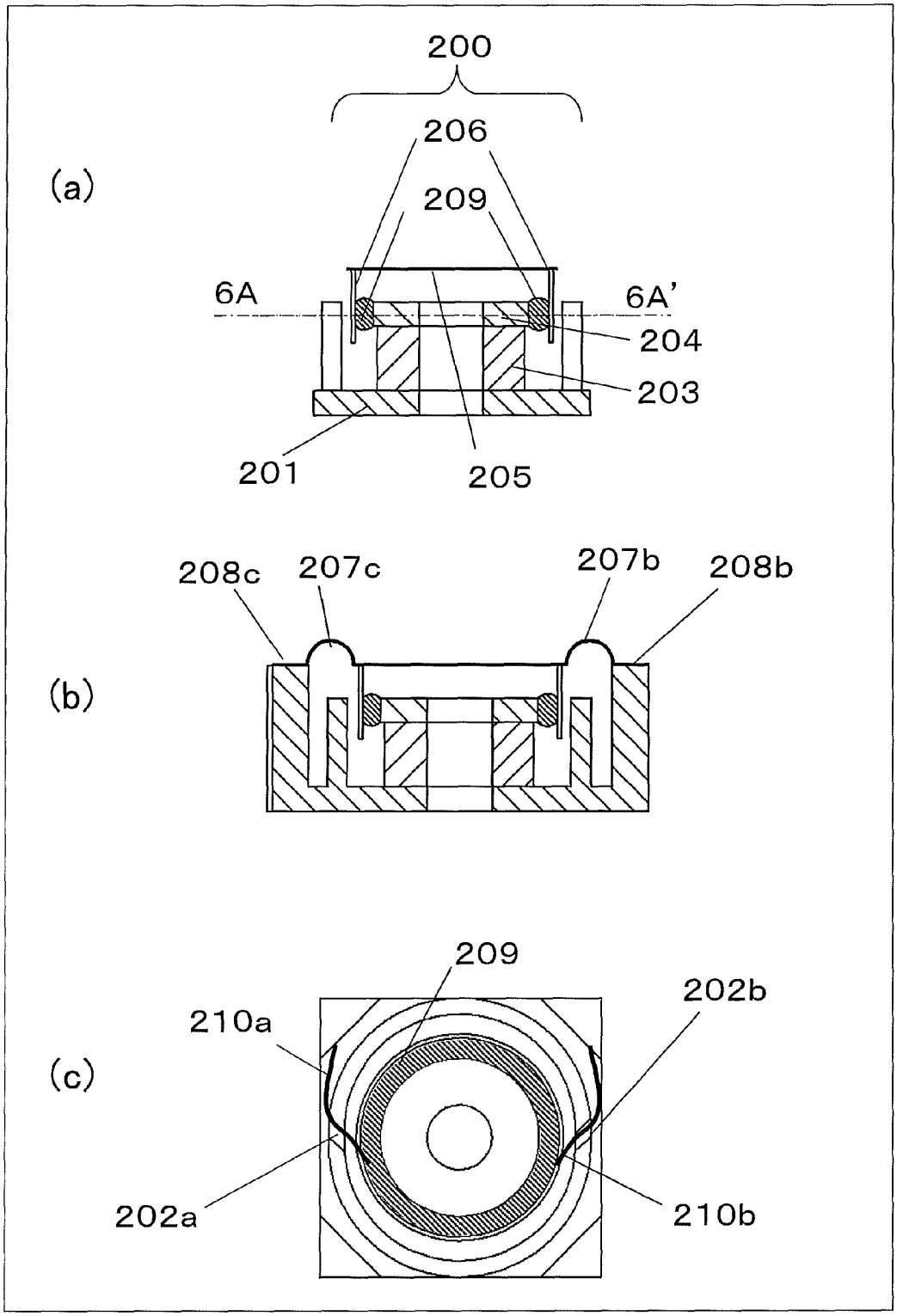
FIG. 17 is a diagram showing cross-sectional views of the loudspeaker shown in FIG. 16.

The configuration of a loudspeaker 200 according to the present disclosure will be described with reference to FIGS. 16 and 17. FIG. 16 is a top view of the loudspeaker 200. FIG. 17(*a*) is a cross-sectional view of the loudspeaker 200 taken along a line 5A-5A' in FIG. 16, FIG. 17(*b*) is a cross-sectional view of the loudspeaker 200 taken along a line 5B-5B' in FIG. 16, and FIG. 17(*c*) is a cross-sectional view of the loudspeaker 200 taken along a line 6A-6A' in FIG. 17(*a*). The loudspeaker 200 includes, a yoke 201, a magnet 203, a plate 204, a diaphragm 205, a voice coil 206, suspensions 207*a* to 207*d*, suspension bonding platforms 208*a* to 208*d*, and a magnetic fluid 209. As shown in FIG. 17(*c*), the voice coil 206 has leads 210*a* and 210*b*. The yoke 201 has cutouts 202*a* and 202*b*. The outer shape of the loudspeaker 200 viewed from the top is a substantially square shape as shown in FIG. 16. The outer shape of the magnet 203, the plate 204, and the voice coil 206 is a substantially perfect circular shape, and the outer shape of the yoke 201 and the diaphragm 205 is a substantially elliptical shape having a long diameter in the vertical direction in the figure.

The positional relationship and the contact relationship among the yoke 201, the magnet 203, the plate 204, the diaphragm 205, the voice coil 206, the magnetic fluid 209, and the cutouts 202*a* and 202*b* are identical to those described with reference to FIGS. 9 to 13 except that the yoke 201, the magnet 203, the plate 204, the diaphragm 205, and the voice coil 206 each have a substantially circular shape. The cutouts 202*a* and 202*b* are formed in the two sidewalls of the yoke 201 at the both ends of the short diameter, as linear slits that are point-symmetrical with each other with respect to the center of the loudspeaker 200 and are inclined with respect to the short axis of the loudspeaker 200. In contrast to the suspensions described with reference to FIGS. 9 to 13, the suspensions 207*a* to 207*d* each have a strip shape and are arranged at four positions as shown in FIG. 16. The suspensions 207*a* to 207*d* are connected to the diaphragm 205 at the center sides thereof, and are fixed to the suspension bonding platforms 208*a* to 208*d*, respectively.

The operation of the loudspeaker 200 configured as described above is identical to the operation of the loudspeaker 100.

In the loudspeaker 200, the outer circumference of the plate 204 has a substantially perfect circuit shape, while the inner circumference of the side wall of the yoke 201 has a substantially elliptical shape. Therefore, the distance between the inner circumference of the yoke 201 and the outer circumference of the plate 204 in the vicinity of the cutout 202*a*, 202*b* is smaller than the distance between the inner circumference of the yoke 201 and the outer circumference of the plate 204 in the long diameter direction of the yoke 201, thereby providing a small and thin loudspeaker with improved reliability and low-pitch sound reproduction ability, which realizes both prevention of contact of the lead wires to other components and uniform holding of the magnetic fluid.

Further, in the loudspeaker 200, since the cutout 202*a*, 202*b* is provided in the side wall of the yoke 201 so as to have an inclined linear shape, a space for loosely bending the lead wire 210*a*, 210*b* can be easily secured inside the loudspeaker 200, thereby avoiding the risk of breakage of the lead wire 210*a*, 210*b* due to a pulling force.

In the loudspeaker 200, the outer circumference of the plate 204 has a substantially perfect circular shape, and the inner circumference of the side wall of the yoke 201 has a substantially elliptical shape. Alternatively, the shapes of the plate 204 and the yoke 201 are not limited thereto. For example, the outer shape of the magnet 203, the plate 204, and the voice coil 206 may be a substantially elliptical shape having a long diameter in the horizontal direction in FIG. 16(*a*), and the outer shape of the yoke 201 and the diaphragm 205 may be a substantially perfect circular shape.

In the loudspeaker 200, the cutouts 202*a* and 202*b* are linear slits that are point-symmetrical with each other and are inclined with respect to the short axis. Alternatively, the cutouts 202*a* and 202*b* may be linear slits that are linear-symmetrical with each other with respect to the short axis direction of the yoke 201. According to this configuration, both the lead wires 210*a* and 210*b* can be pulled out without bending them at their roots, thereby avoiding the risk of breakage of the lead wires 210*a* and 210*b* due to repeated bending.

Figure 18:
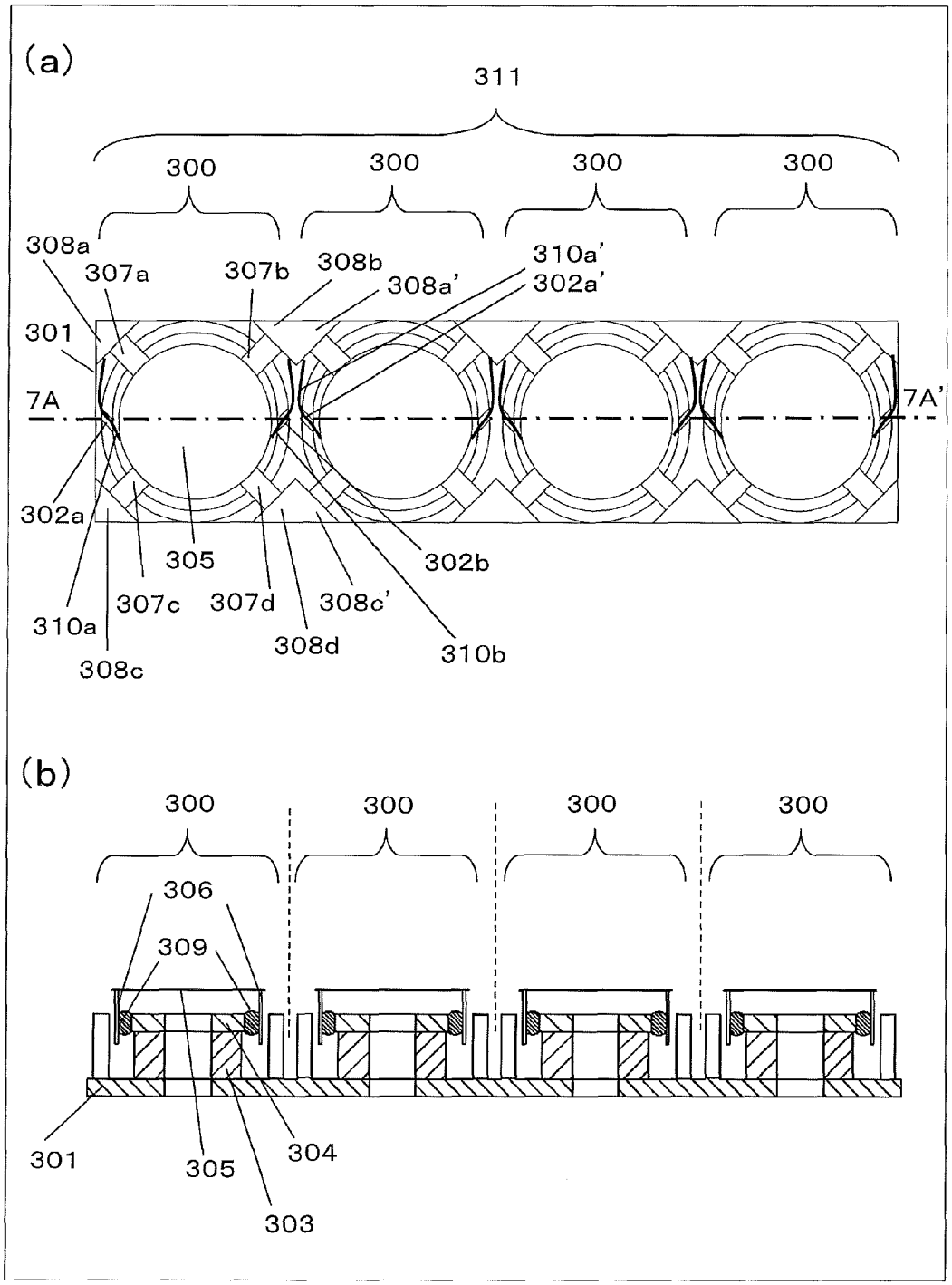
FIG. 18 is a diagram for explaining a loudspeaker array according to the present disclosure.

The configuration of a loudspeaker array 311 according to the present disclosure will be described with reference to FIG. 18. FIG. 18(*a*) is a top view of the loudspeaker array 311, and FIG. 18(*b*) is a cross-sectional view of the loudspeaker array 311 taken along a line 7A-7A' in FIG. 18(*a*). The loudspeaker array 311 is composed of four loudspeakers 300 that are linearly arranged. Each loudspeaker 300 has a shape and a configuration equivalent to those of the loudspeaker 200, and includes a yoke 301, a magnet 303, a plate 304, a diaphragm 305, a voice coil 306, suspensions 307*a* to 307*d*, suspension bonding platforms 308*a* to 308*d*, and a magnetic fluid 309. The voice coil 306 includes leads 310*a* and 310*b* as shown in FIG. 17(*a*). The yoke 301 includes cutouts 302*a* and 302*b*. Among the suspension bonding platforms 308*a* to 308*d*, the suspension bonding platform 308*b* is integrated with a suspension bonding platform 308*a*' of the adjacent loudspeaker 300, and the suspension bonding platform 308*d* is integrated with a suspension bonding platform 308*c*' of the adjacent loudspeaker 300.

The operation of the loudspeaker 300 configured as described above is identical to the operation of the loudspeaker 200. Accordingly, like the loudspeaker 200, the loudspeaker 300 realizes both prevention of contact of the lead wires with other components and uniform holding of the magnetic fluid. Therefore, according to the loudspeaker array 311 of the present disclosure, it is possible to provide a narrow and thin loudspeaker array with improved reliability and low-pitch sound reproduction ability.

Further, in the loudspeaker 300, the cutout 302*b* and a cutout 302*a*' of the adjacent loudspeaker 300 are formed so that the lead 310*b* and a lead 310*a*' are connected to the outside at the same side with respect to the 7A-7A' cross section. Therefore, the leads of the adjacent loudspeakers 300 are prevented from contacting each other, thereby avoiding occurrence of abnormal noise.

In the loudspeaker array 311, the loudspeaker 300 has a substantially square shape equivalent to that of the loudspeaker 200. Alternatively, the shape of the loudspeaker 300 is not limited thereto. The loudspeaker 300 may have a substantially oblong shape equivalent to that of the loudspeaker 100 described with reference to FIGS. 14 and 15, and the loudspeakers 300 may be arranged along the long side direction. According to this configuration, it is possible to realize a narrower loudspeaker array 311.

In the above description, each yoke 301 is formed of the cylindrical side wall and the bottom portion. Alternatively, the yokes 301 of the loudspeaker array 311 may be formed as a plurality of cylindrical recesses, and an oblong outer peripheral portion of the loudspeaker array 311 may be integrally formed as an outer wall of the yokes 301. In this case, it is desirable that cutouts are formed as grooves on a base formed of the outer wall and the bottom portion. According to this configuration, the yokes 301 need not be separately formed, thereby achieving reduction in production costs.

In the above description, the four loudspeakers 300 constituting the loudspeaker array 311 each have the independent leads 310*a* and 310*b*. Alternatively, the voice coils 306 of the adjacent loudspeakers 300 may share the leads, and the loudspeakers 300 may be connected in series. In this case, it is desirable that each cutout has a linear shape along the 7A-7A' cross section. According to this configuration, the loudspeaker array 311 has only two terminal ends of the leads at the both ends of the loudspeaker array 311, thereby further reducing the risk of contact of the leads with other components.

A case where the loudspeaker 100 is installed in an inner-ear headphone 410 will be described with reference to FIG.

Figure 19:
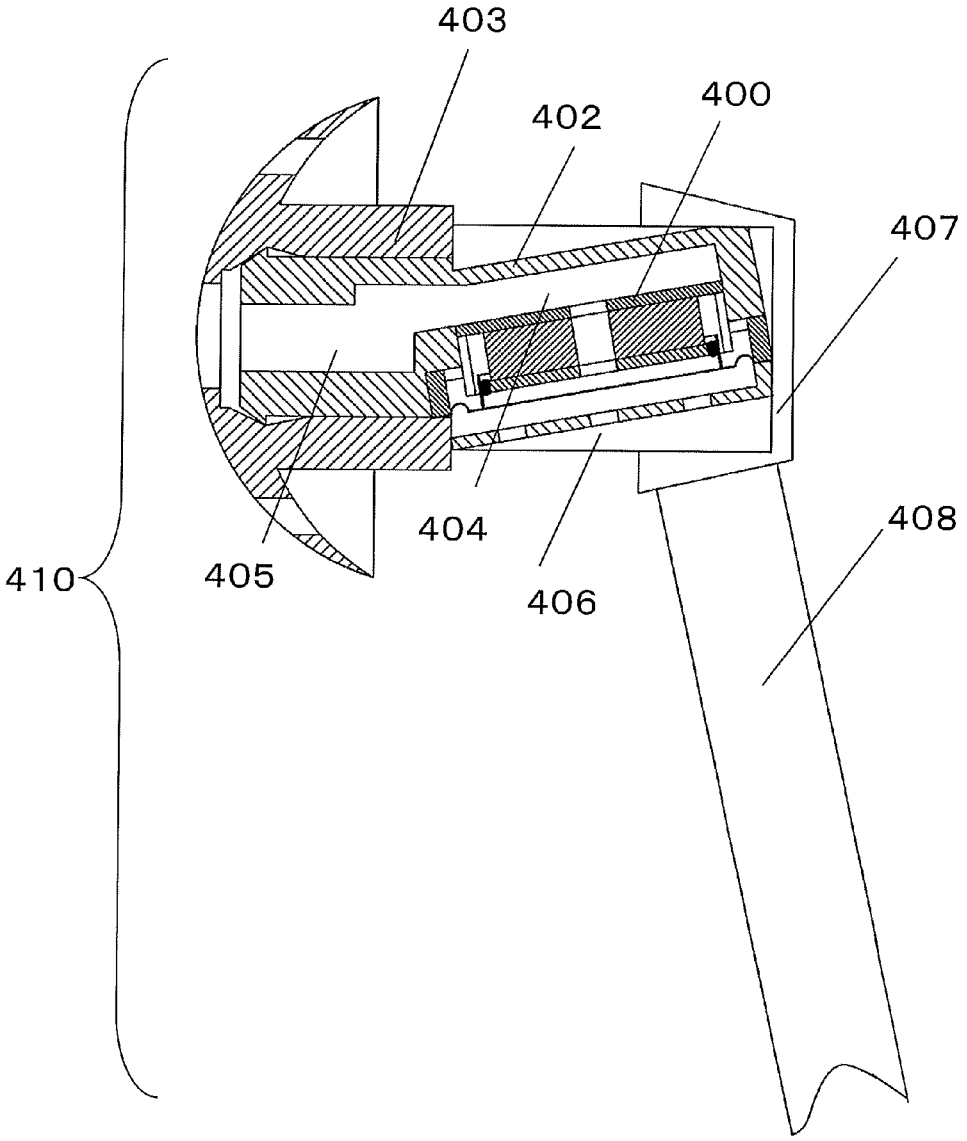
FIG. 19 is a diagram showing a partially cross-sectional view of an inner-ear headphone according to the present disclosure.

19. FIG. 19 is a partial cross-sectional view of the an inner-ear headphone 410. FIG. 19 shows cross sections of a loudspeaker 400, a case 402, and an ear chip 403, and a housing 407 and a cord 408 among components of the inner ear headphone 410. The case 402 includes a front volume 404, a port 405, and a back sound hole 406. The loudspeaker 400 has a shape and a configuration similar to those of the loudspeaker 100. The loudspeaker 400, having a surface of a diaphragm confronting a magnetic circuit as a sound wave emitting surface, outputs sound to an external auditory canal of a hearer via the front volume 404, the port 405, and the ear chip 403.

The loudspeaker 400, having the configuration of the present disclosure, realizes both prevention of contact of the lead wires with other components and uniform holding of the magnetic fluid. Thereby, even in a case where the inner-ear headphone 410 moves when a wearer moves or swings and thereby the magnetic fluid is subjected to an external force that prompts the fluid to move with respect to the magnetic circuit, it is possible to prevent reduction in efficiency due to non-uniform distribution of the magnetic fluid, and air leakage due to absence of the magnetic fluid, and thus volume reduction is avoided.

When the loudspeaker 400 is attached so as to be inclined with respect to a back surface of an earpiece, it is possible to prevent sound of an opposite phase emitted from the back sound hole 406 from interfering with sound to be heard by the hearer, while reducing the diameter of the port so that the port can be inserted in an entrance of an external auditory canal, and thus volume reduction is avoided. According to the inner-ear headphone 410 of the present disclosure, since the plate has the configuration of the present disclosure, it is possible to provide an inner-ear headphone that is small in size, is capable of reproducing a wide frequency band from a low-pitch sound range to a high-pitch sound range, and realizes both improved wearing comfort and high sound quality.

Figure 20:
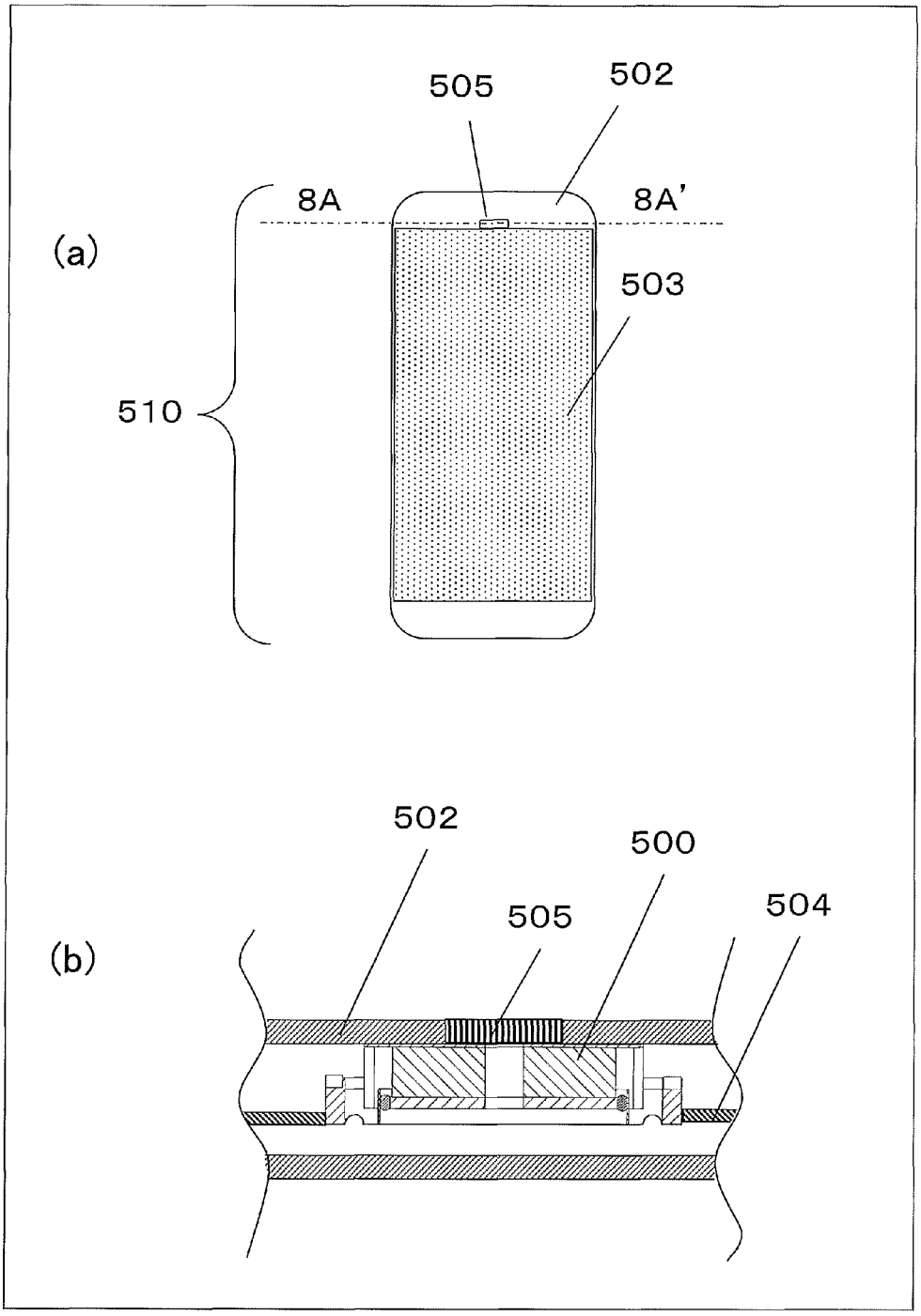
FIG. 20 is a diagram for explaining a mobile information terminal according to the present disclosure.

A case where the loudspeaker 100 is installed as an audio receiver in a mobile information terminal will be described with reference to FIG. 20. FIG. 20(*a*) is an external view of a mobile information terminal 510. FIG. 20(*b*) is a cross-sectional view of the mobile information terminal 510 taken along a line 10A-10A'. FIG. 20 shows, among components of the mobile information terminal 510, a loudspeaker 500, a case 502, a display 503, a base plate 504, and a sound hole 505.

The loudspeaker 500, being attached to a perforated portion provided on the base plate 504, is housed in the case 502. Further, the loudspeaker 500 has a shape and a configuration equivalent to those of the loudspeaker 100. The loudspeaker 500, having a surface of a diaphragm confronting a magnetic circuit as a sound wave emitting surface, outputs a speech voice to an ear of a user via the sound hole 505. Like the inner-ear headphone 410, since the loudspeaker 500 has the configuration of the present disclosure, it is possible to prevent reduction in efficiency from being caused by non-uniform distribution of the magnetic fluid or absence of the magnetic fluid due to move or swing of the mobile information terminal 510, and thus volume reduction can be avoided.

Figure 21:
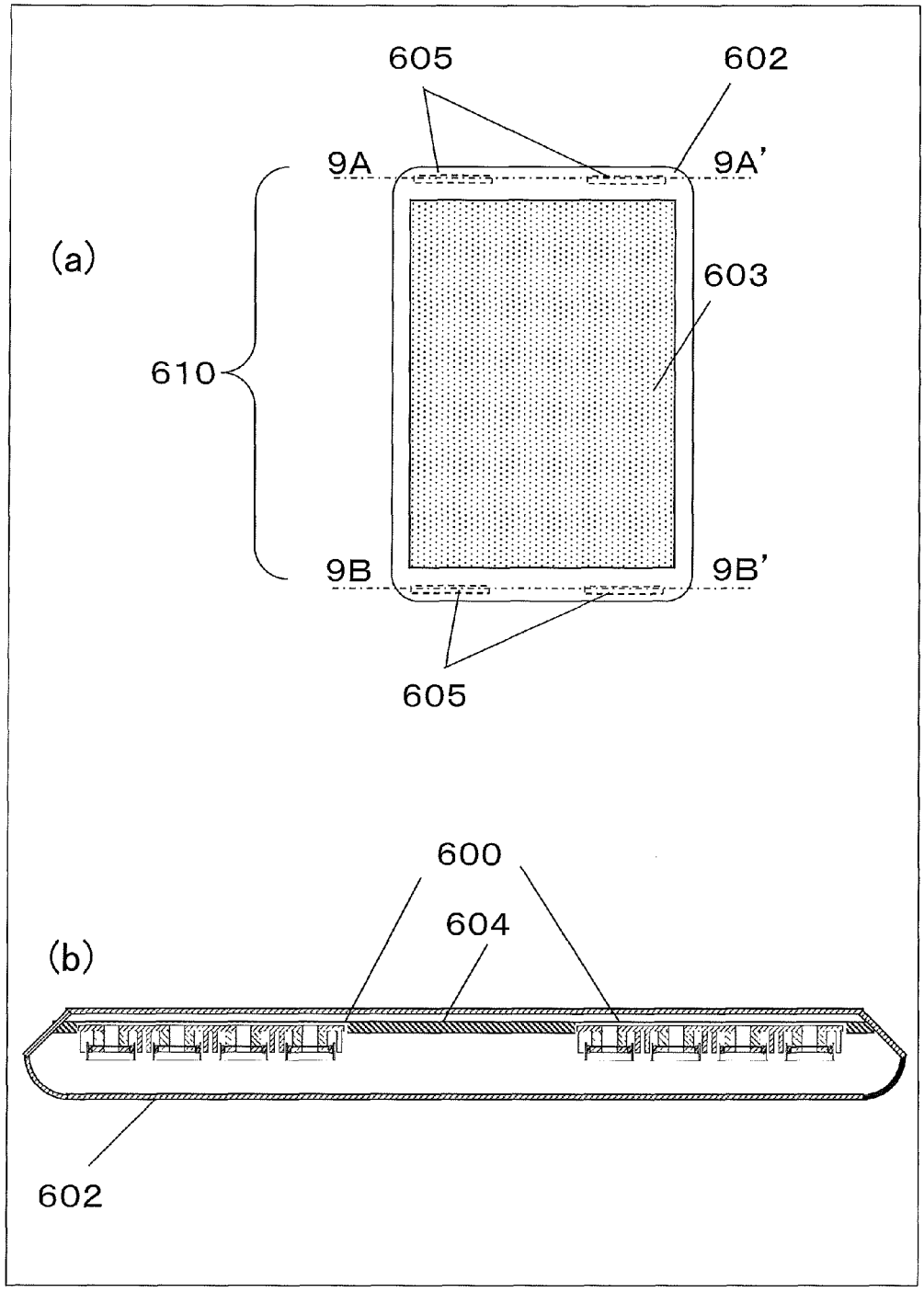
FIG. 21 is a diagram for explaining a video audio information terminal according to the present disclosure.

A case where the loudspeaker 200 is installed as a loudspeaker in a tablet type video audio information terminal will be described with reference to FIG. 21. FIG. 21(*a*) is an external view of a video audio information terminal 610. FIG. 21(*b*) is a cross-sectional view of the video audio information terminal 610 taken along a line 9A-9A' or a line 9B-9B'. FIG. 21 shows, among components of the video audio information terminal 610, a loudspeaker module 600, a case 602, a display 603, a case reinforcing frame 604, and a sound hole 605. The loudspeaker module 600, being attached to the case reinforcing frame 604, is housed in the case 602. Further, the loudspeaker module 600 has a shape and a configuration equivalent to those of the loudspeaker array 311. The loudspeaker module 600, having a surface of a diaphragm confronting a magnetic circuit as a sound wave emitting surface, outputs a speech voice to an ear of a user. Like the inner-ear headphone 410, since the loudspeaker module 600 has the configuration of the present disclosure, it is possible to prevent reduction in efficiency from being caused by non-uniform distribution of the magnetic fluid or absence of the magnetic fluid due to move or swing of the mobile information terminal 510, and thus volume reduction can be avoided.

While FIG. 18 shows the loudspeaker array 311 in which the loudspeakers 200 are arrayed, the configuration and shape of the loudspeakers to be arrayed are not limited thereto, and the configuration and shape of the loudspeaker 100 may be adopted.

While FIGS. 19 and 20 show the case where the loudspeaker 100 is installed, the configuration and shape of the loudspeaker are not limited thereto, and the configuration and shape of the loudspeaker 200 may be adopted.

While FIG. 21 shows the case where the loudspeaker array 311 shown in FIG. 18 is installed, the configuration and shape of the loudspeaker are not limited thereto, and the configuration and shape of the loudspeaker 100 or 200 may be adopted.

While FIGS. 19, 20, and 21 show the cases where the loudspeaker or the loudspeaker array according to the present disclosure is installed in an inner-ear headphone, a mobile information terminal, and a tablet type video audio information terminal, respectively, devices on which the loudspeaker or the loudspeaker array is installed are not limited thereto. For example, the loudspeakers according to the present disclosure may be installed in a hearing aid, a headset, a display device, and the like.

INDUSTRIAL APPLICABILITY

As described above, according to the present disclosure, even a slim loudspeaker can make distribution of a magnetic fluid in a magnetic gap uniform. Therefore, it is possible to realize a loudspeaker excellent in low-pitch sound reproduction in spite of its slim shape for installation in a television, a tablet terminal, and a smartphone whose frames become narrower. Further, for an earphone, a hearing aid, and the like, a slim loudspeaker that can be inserted in an external auditory canal is realized. Therefore, it is possible to set the loudspeaker in the vicinity of an eardrum. Thus, it is possible to realize an equivalent sound pressure level with less input power as compared to the conventional input power.

Further, according to the present disclosure, it is possible to provide a small and thin loudspeaker with improved reliability and low-pitch sound reproduction ability, and the loudspeaker is applicable to an inner-ear headphone, a mobile information terminal, a video audio information terminal, a hearing aid, a headset, a display device, and other AV (Audio Visual) devices.

DESCRIPTION OF THE REFERENCE CHARACTERS

In FIG. 1 to FIG. 8, and FIG. 22

100, 203, 300, 400, 500, 600, 700 loudspeaker
101, 301, 401, 501, 601 yoke
102, 302, 402, 502, 602 magnet
103, 303, 403, 503, 603 plate
104, 304, 404, 504, 604 diaphragm

105*a*, 105*b*, 305*a*, 305*b*, 405*a*, 405*b*, 505*a*, 505*b*, 605*a*, 605*b* suspension
106, 306, 406, 506, 606 voice coil
107, 307, 507, 607 magnetic gap
108, 308, 408, 508, 608, 708 sound hole
109, 609 rib
110, 310, 410, 510, 610 magnetic fluid
201 case
202 display
411 auxiliary magnet
P, Q, R, S point
LP, LQ distance
w1, w2 width
In FIG. 9 to FIG. 21, FIG. 23, and FIG. 24
100, 200, 300, 400, 500, 700, 1100, 1200 loudspeaker
101, 201, 301, 701, 1101, 21, 1201 yoke
102*a*, 102*b*, 202*a*, 202*b*, 302*a*, 302*b*, 1202*a*, 1202*b* cutout
103, 203, 303, 703, 1102 magnet
104, 204, 304, 704, 1103, 23, 1204 plate
105, 205, 305, 705, 1106 diaphragm
106, 206, 306, 706, 1107, 33, 1206 voice coil
107*a*, 107*b*, 207*a* to 207*d*, 307*a* to 307*d*, 707*a*, 707*b* suspension
108*a*, 108*b* frame
208*a* to 208*d*, 308*a* to 308*d*, 308*a*', 308*c*', 708*a*, 708*b* suspension bonding platform
109, 209, 309, 709, 1110, 1209 magnetic fluid
110*a*, 110*b*, 210*a*, 210*b*, 310*a*, 310*b* lead
311 loudspeaker array
410 inner-ear headphone
402 case
404 front volume
405 port
406 back sound hole
407 housing
408 cord
510 mobile information terminal
502, 602 case
503, 603 display
504 base plate
505, 605*a* to 605*d* sound hole
610 video audio information terminal
600*a* to 600*d* loudspeaker module
604 case reinforcing frame
1108*a* to 1108*d* edge piece
1109 spacer
G2 magnetic gap
1 loudspeaker device
21C side portion
22 magnet
3 vibrator
4 lead wire
5 frame
6 terminal part
71 cutout

The invention claimed is:

1. A loudspeaker, comprising:

a magnetic circuit including a magnet, a plate fixed to one of a pair of polar surfaces of the magnet, and a box-shaped yoke having an inner bottom surface fixed to the other polar surface of the magnet;

a voice coil provided in a magnetic gap formed by the plate and the yoke, the voice coil being vibratable in a vertical direction;

a diaphragm having a peripheral edge connected to an upper end of the voice coil;

a magnetic fluid filled in at least one of a gap between the voice coil and the plate and a gap between the voice coil and the yoke; and a sound hole penetrating through the plate, the magnet, and the yoke is provided by combining openings of the same shape which are formed in the plate, the magnet, and the yoke, respectively, and given that, as viewed in a direction along a through-axis of the sound hole, a point on an outer circumference of the plate closest to a center of gravity of the sound hole is a third point, a shortest distance between the third point and the voice coil is a third distance, a point on the outer circumference of the plate farthest from the center of gravity of the sound hole is a fourth point, and a shortest distance between the fourth point and the voice coil is a fourth distance, the third distance is larger than the fourth distance, wherein the loudspeaker includes at least one means for uniformly distributing the magnetic fluid.

2. The loudspeaker according to claim 1 including, as the means, the sound hole provided penetrating through the plate, the magnet, and the yoke.

3. The loudspeaker according to claim 2, wherein given that, as viewed in a direction along a through-axis of the sound hole, a point on an outer circumference of the plate closest to a center of gravity of the sound hole is a first point, a shortest distance between the first point and an outer circumference of the sound hole is a first distance, a point on the outer circumference of the plate farthest from the center of gravity of the sound hole is a second point, and a shortest distance between the second point and the outer circumference of the sound hole is a second distance, the first distance is smaller than the second distance.

4. The loudspeaker according to claim 2 including, as the means, a plurality of the sound hole provided penetrating through the plate, the magnet, and the yoke, each sound hole being formed by combining openings of the same shape which are formed in the plate, the magnet, and the yoke, respectively.

5. The loudspeaker according to claim 2, wherein the sound hole is provided at least in an area where a magnetic flux density is high.

6. The loudspeaker according to claim 2, wherein an outer circumferential shape of a horizontal cross section of the magnet is a track shape, and the sound hole has a track shape as viewed in the penetration axis direction, and is provided at a position in which a magnetic flux density of a magnetic flux penetrating the outer circumference of a linear portion of the magnet is to be reduced.

7. The loudspeaker according to claim 1 including, as the means, the voice coil whose shape is adjusted so as to cause the magnetic fluid to uniformly distribute in the at least one gap.

8. The loudspeaker according to claim 1 including, as the means, auxiliary magnets provided outside the voice coil.

9. The loudspeaker according to claim 8, wherein a horizontal cross section of the voice coil has a track shape, and the auxiliary magnets are provided on the outer circumference of the voice coil at both the short sides thereof so as to have a radius of curvature equal to that of the outer circumference of the plate.

10. AV (Audio Visual) equipment being provided with the loudspeaker according to claim 1, the AV (Audio Visual)

equipment including a television, a mobile phone, a smartphone, a tablet terminal, an earphone, and a hearing aid.

11. A loudspeaker, comprising:

a magnetic circuit including a magnet, a plate fixed to one of a pair of polar surfaces of the magnet, and a box-shaped yoke having an inner bottom surface fixed to the other polar surface of the magnet;

a voice coil provided in a magnetic gap formed by the plate and the yoke, the voice coil being vibratable in a vertical direction;

a diaphragm having a peripheral edge connected to an upper end of the voice coil; and a magnetic fluid filled in at least one of a gap between the voice coil and the plate and a gap between the voice coil and the yoke, wherein a shape of an inner edge of an outer magnetic pole of the magnetic circuit with respect to the voice coil and a shape of an outer edge of an inner magnetic pole of the magnetic circuit with respect to the voice coil are each composed of, as viewed from the top, two substantially linear portions opposed to each other, and two curved portions opposed to each other and having an outwardly convex shape, and a gap between the inner edge of the outer magnetic pole and the outer edge of the inner magnetic pole is formed by the linear portions of the outer magnetic pole and the inner magnetic pole and the curved portions of the outer magnetic pole and the inner magnetic pole, and the gap is smaller between the curved portions than between the linear portions.

12. The loudspeaker according to claim 11, wherein the magnetic circuit has a track shape or a rectangular shape as viewed from the top.

13. The loudspeaker according to claim 11, wherein the yoke has, in each of the curved portions, at least two slits through which lead wires of the voice coil are taken out of the magnetic circuit.

14. The loudspeaker according to claim 13, wherein the slits are cutouts extending to an upper end of the yoke.

15. The loudspeaker according to claim 13, wherein the slits are through holes provided in a side wall of the yoke so as to have a predetermined clearance at each of upper and lower limits of a swing of the lead lines.

16. An inner-ear headphone including the loudspeaker according to claim 11.

17. A mobile information terminal including the loudspeaker according to claim 11.

18. A tablet type video audio information terminal including the loudspeaker according to claim 11.

* * * * *